US010843467B2

(12) United States Patent
Nakai et al.

(10) Patent No.: US 10,843,467 B2
(45) Date of Patent: Nov. 24, 2020

(54) LIQUID EJECTING APPARATUS

(71) Applicant: CANON KABUSHIKI KAISHA, Tokyo (JP)

(72) Inventors: Hiroshi Nakai, Sagamihara (JP); Noriko Sato, Kawasaki (JP); Yoshinori Nakagawa, Kawasaki (JP); Takatoshi Nakano, Yokohama (JP); Atsushi Takahashi, Tama (JP); Takuya Fukasawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/024,977

(22) Filed: Jul. 2, 2018

(65) Prior Publication Data

US 2019/0009553 A1 Jan. 10, 2019

(30) Foreign Application Priority Data

Jul. 7, 2017 (JP) ..... 2017-133537

(51) Int. Cl.
*B41J 2/165* (2006.01)

(52) U.S. Cl.
CPC ..... *B41J 2/16511* (2013.01); *B41J 2/16508* (2013.01); *B41J 2/16517* (2013.01); *B41J 2/16538* (2013.01); *B41J 2/16544* (2013.01); *B41J 2/16588* (2013.01); *B41J 2002/16582* (2013.01)

(58) Field of Classification Search
CPC ..... B41J 2/16508; B41J 2/16517; B41J 2/16538; B41J 2/16544; B41J 2/16588; B41J 2/16511
See application file for complete search history.

(56) References Cited

U.S. PATENT DOCUMENTS

| | | | |
|---|---|---|---|
| 6,984,009 | B2 | 1/2006 | Nakagawa et al. |
| 7,011,386 | B2 | 3/2006 | Iwasaki et al. |
| 7,144,096 | B2 | 12/2006 | Seki et al. |
| 7,396,095 | B2 | 7/2008 | Nakagawa et al. |
| 7,896,463 | B2 | 3/2011 | Nakagawa et al. |
| 8,714,699 | B2 | 5/2014 | Suzuki |

(Continued)

FOREIGN PATENT DOCUMENTS

| | | | |
|---|---|---|---|
| JP | 2013180446 | A | 9/2013 |
| JP | 5668448 | B2 | 2/2015 |

OTHER PUBLICATIONS

Unpublished, copending U.S. Appl. No. 16/023,007, filed Jun. 29, 2018 to Takuya Fukasawa et al.

(Continued)

*Primary Examiner* — Lamson D Nguyen
(74) *Attorney, Agent, or Firm* — Venable LLP

(57) ABSTRACT

There is provided a liquid ejecting apparatus including: a print head having an ejection opening surface on which an ejection opening array for ejecting a liquid is provided in a first direction; a cap unit for protecting the ejection opening array; a moving unit configured to relatively move the print head and the cap unit; a first positioning portion for locating the print head and the cap unit in a first relative position where the print head and the cap unit come into contact with each other; and a second positioning portion for locating the print head and the cap unit in a second relative position where the print head and the cap unit come into contact with each other, the second relative position being different from the first relative position.

32 Claims, 24 Drawing Sheets

(56) References Cited

U.S. PATENT DOCUMENTS

| | | | |
|---|---|---|---|
| 8,752,930 | B2 | 6/2014 | Doi et al. |
| 8,827,419 | B2 | 9/2014 | Nakagawa et al. |
| 8,944,562 | B2 | 2/2015 | Nakagawa et al. |
| 9,096,065 | B2 | 8/2015 | Nakano et al. |
| 9,108,410 | B2 | 8/2015 | Hamasaki et al. |
| 9,387,679 | B2 | 7/2016 | Shiiba et al. |
| 9,446,595 | B2 | 9/2016 | Takarabe et al. |
| 9,517,628 | B2 | 12/2016 | Tenkawa et al. |
| 9,862,195 | B2 | 1/2018 | Genta et al. |
| 2004/0041862 | A1 | 3/2004 | Nakagawa et al. |
| 2013/0100200 | A1 | 4/2013 | Hamasaki et al. |
| 2016/0052278 | A1 | 2/2016 | Iwasaki et al. |
| 2018/0001623 | A1 | 1/2018 | Nakano et al. |
| 2018/0022086 | A1 | 1/2018 | Kameshima et al. |
| 2018/0079218 | A1 | 3/2018 | Genta et al. |
| 2018/0154630 | A1 | 6/2018 | Takahashi et al. |

OTHER PUBLICATIONS

Unpublished, copending U.S. Appl. No. 16/027,552, filed Jul. 5, 2018 to Noriko Sato et al.
Unpublished, copending U.S. Appl. No. 16/024,973, filed Jul. 2, 2018 to Takuya Fukasawa et al.
Unpublished, copending U.S. Appl. No. 16/021,116, filed Jun. 28, 2018 to Takuya Fukasawa et al.
Unpublished, copending U.S. Appl. No. 15/955,813, filed Apr. 18, 2018 to Hiroshi Nakai et al.
Unpublished, copending U.S. Appl. No. 15/955,005, filed Apr. 17, 2018 to Takahiro Kiuchi et al.
Unpublished, copending U.S. Appl. No. 16/052,997, filed Aug. 2, 2018 to Yoshinori Nakagawa et al.

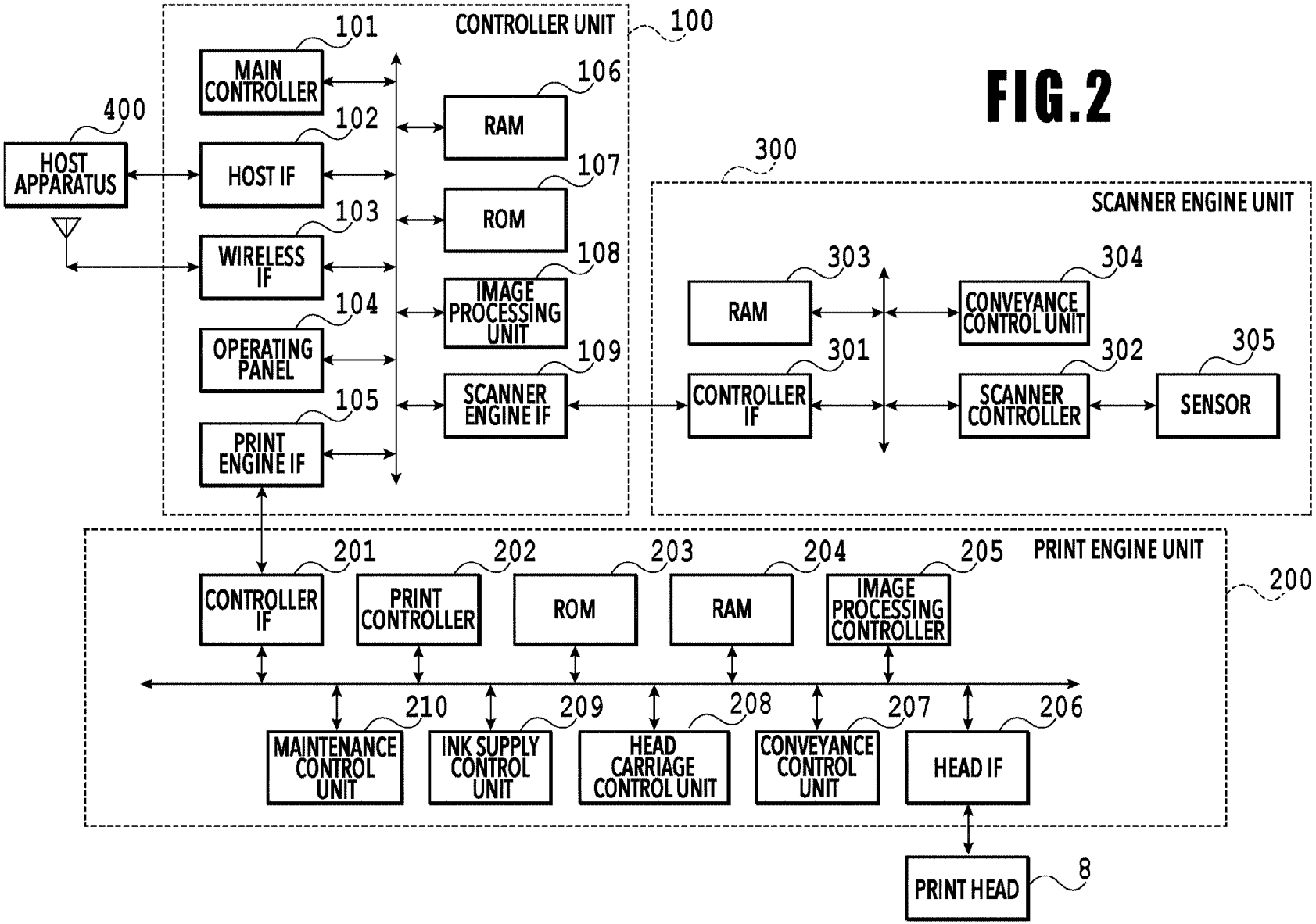
FIG.2
100
CONTROLLER UNIT
101
MAIN CONTROLLER
102
HOST IF
103
WIRELESS IF
104
OPERATING PANEL
105
PRINT ENGINE IF
106
RAM
107
ROM
108
IMAGE PROCESSING UNIT
109
SCANNER ENGINE IF
400
HOST APPARATUS
300
SCANNER ENGINE UNIT
301
CONTROLLER IF
302
SCANNER CONTROLLER
303
RAM
304
CONVEYANCE CONTROL UNIT
305
SENSOR
200
PRINT ENGINE UNIT
201
CONTROLLER IF
202
PRINT CONTROLLER
203
ROM
204
RAM
205
IMAGE PROCESSING CONTROLLER
206
HEAD IF
207
CONVEYANCE CONTROL UNIT
208
HEAD CARRIAGE CONTROL UNIT
209
INK SUPPLY CONTROL UNIT
210
MAINTENANCE CONTROL UNIT
8
PRINT HEAD

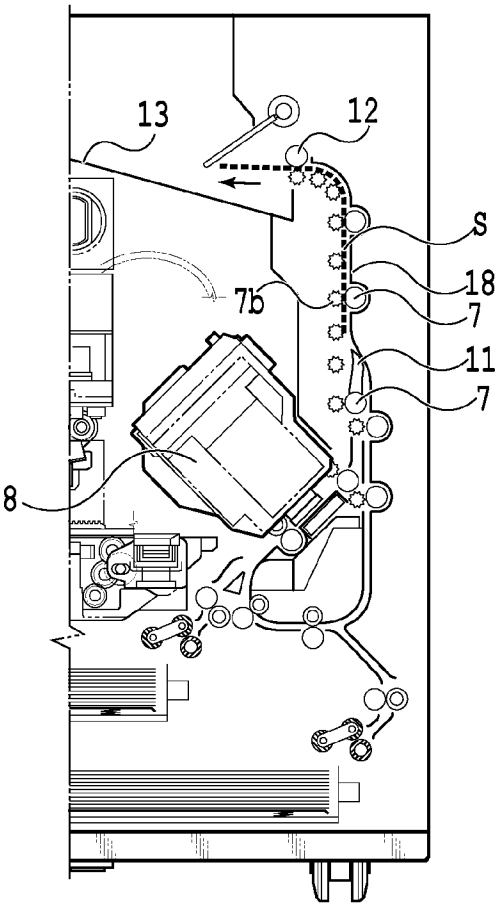
FIG.4C
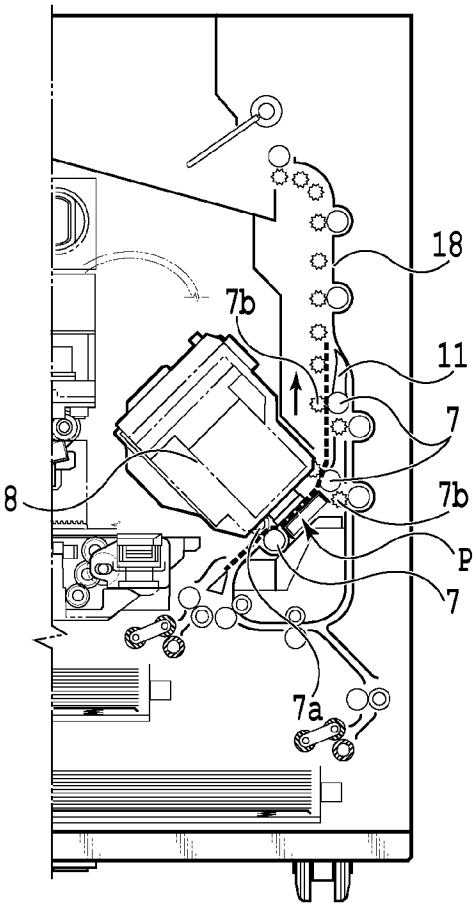
FIG.4B
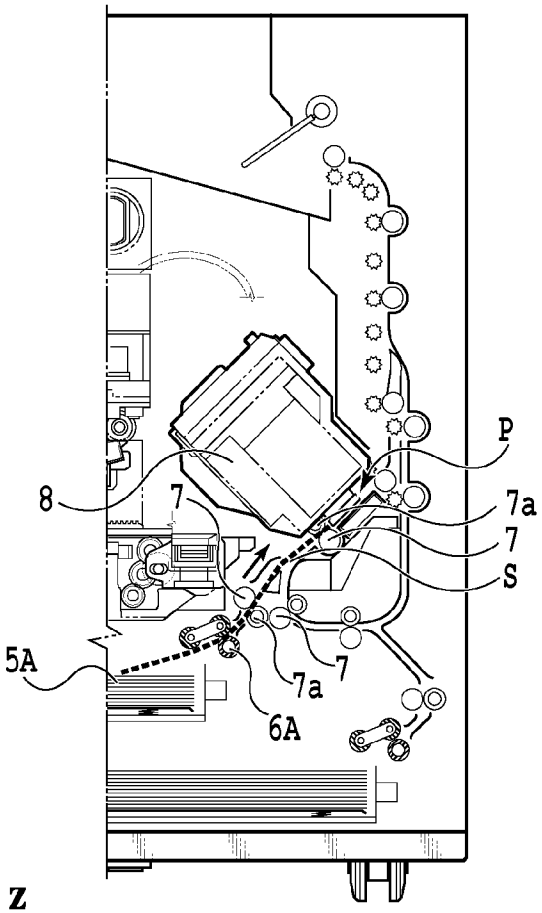
FIG.4A
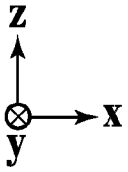

LIQUID EJECTING APPARATUS

BACKGROUND OF THE INVENTION

Field of the Invention

The present invention relates to a liquid ejecting apparatus.

Description of the Related Art

A liquid ejecting apparatus such as an inkjet printing apparatus has a cap for protecting an ejection opening of a print head. Japanese Patent No. 5668448 (hereinafter referred to as PTL 1) discloses a printer capable of uniquely specifying a relative positional relation between a print head and a cap.

There is a need for specifying a plurality of relative positional relations between the print head and the cap. In the technique of PTL 1, while a relative positional relation between the print head and the cap can be uniquely specified, a plurality of relative positional relations cannot be specified.

SUMMARY OF THE INVENTION

According to an aspect of the present invention, there is provided a liquid ejecting apparatus comprising: a print head having an ejection opening surface on which an ejection opening array for ejecting a liquid is provided in a first direction; a cap unit for protecting the ejection opening array; a moving unit configured to relatively move the print head and the cap unit; a first positioning portion for locating the print head and the cap unit in a first relative position where the print head and the cap unit come into contact with each other; and a second positioning portion for locating the print head and the cap unit in a second relative position where the print head and the cap unit come into contact with each other, the second relative position being different from the first relative position. Further features of the present invention will become apparent from the following description of exemplary embodiments with reference to the attached drawings.

BRIEF DESCRIPTION OF THE DRAWINGS

FIG. 2 is a control configuration diagram of the printing apparatus;

FIGS. 4A to 4C are conveying path diagrams of a print medium fed from a first cassette;

DESCRIPTION OF THE EMBODIMENTS

Figure 1:
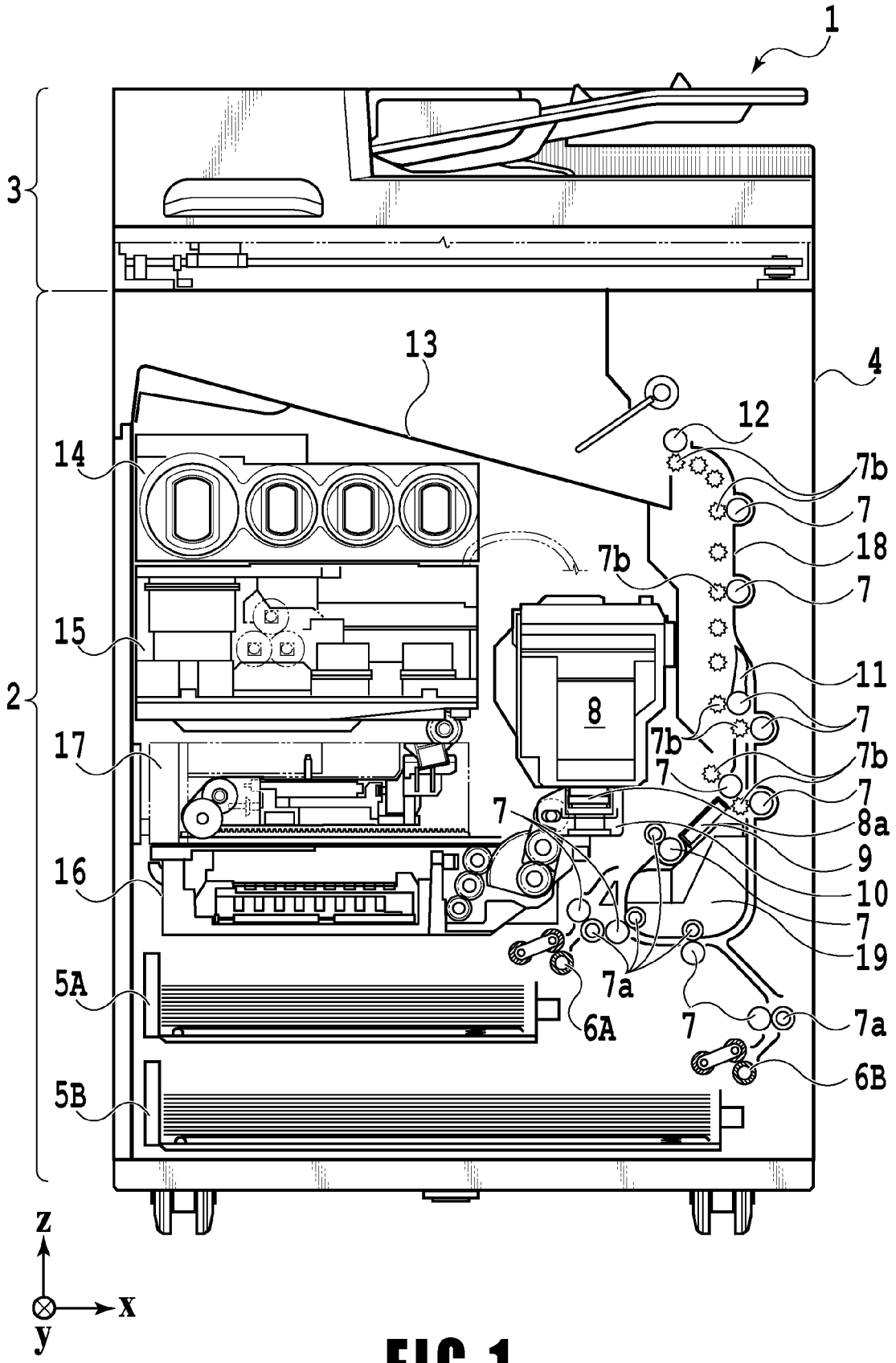
FIG. 1 is a diagram showing a printing apparatus in a standby state.

Embodiments of the present invention will be described with reference to the drawings. It should be noted that the following embodiments do not limit the present invention and that not all of the combinations of the characteristics described in the present embodiments are essential for solving the problem to be solved by the present invention. Incidentally, the same reference numeral refers to the same component in the following description. Furthermore, relative positions, shapes, and the like of the constituent elements described in the embodiments are exemplary only and are not intended to limit the scope of the invention. In the following embodiments, an inkjet printing apparatus will be described as an example of a liquid ejecting apparatus having a liquid ejecting head for ejecting liquid droplets.

First Embodiment

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to a print operation and a scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted.

FIG. 1 shows the printing apparatus 1 in a standby state in which neither print operation nor scan operation is performed.

In the print unit 2, a first cassette 5A and a second cassette 5B for housing a print medium (cut sheet) S are detachably provided at the bottom of a casing 4 in the vertical direction. A relatively small print medium of up to A4 size is placed flat and housed in the first cassette 5A and a relatively large print medium of up to A3 size is placed flat and housed in the second cassette 5B. A first feeding unit 6A for sequentially feeding a housed print medium is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for placing and housing a print medium S that was subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports, from the back side, a print medium S subjected to print operation by the print head 8. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
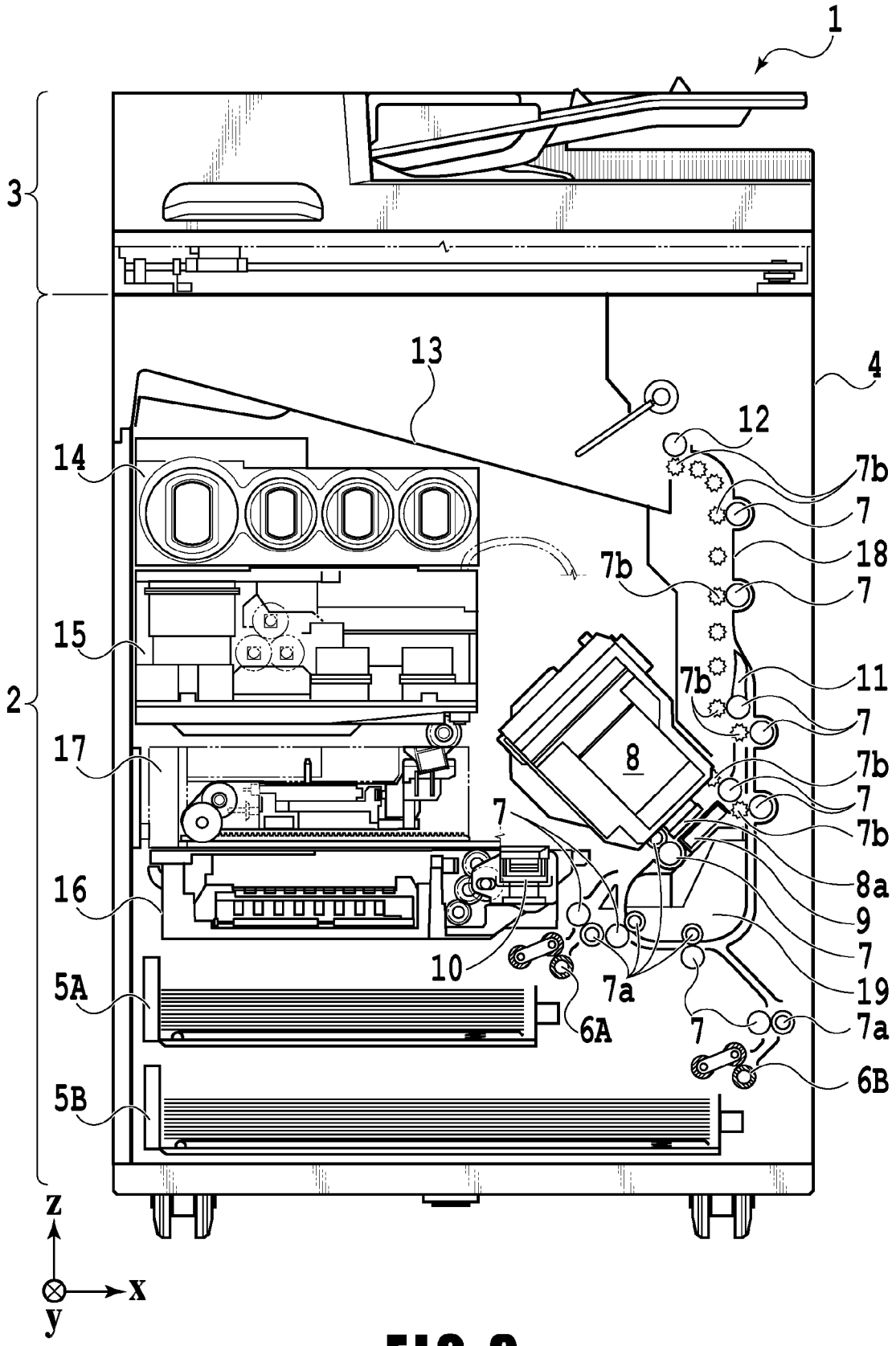
FIG. 3 is a diagram showing the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

FIGS. 4A to 4C are diagrams showing a conveying path in the case of feeding an A4 size print medium S from the first cassette 5A. A print medium S at the top of a print medium stack in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 down.

Figure 5C:
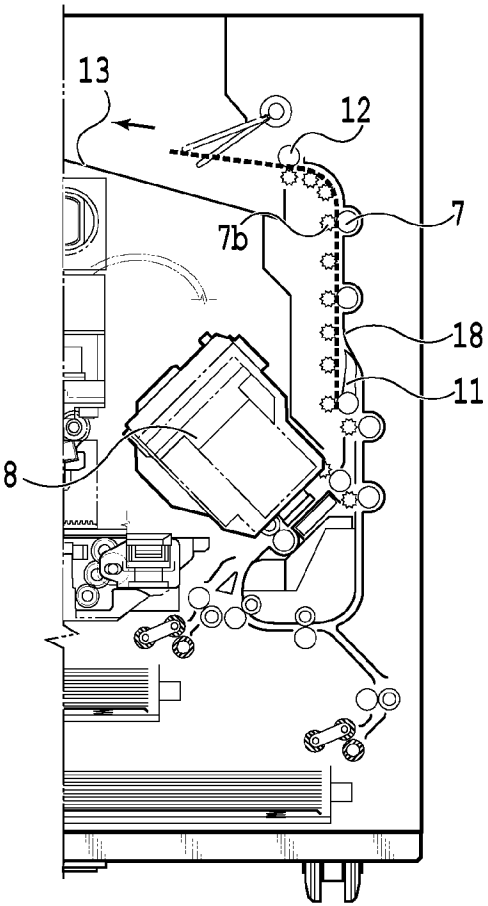
FIGS. 5A to 5C are conveying path diagrams of a print medium fed from a second cassette.
Figure 5B:
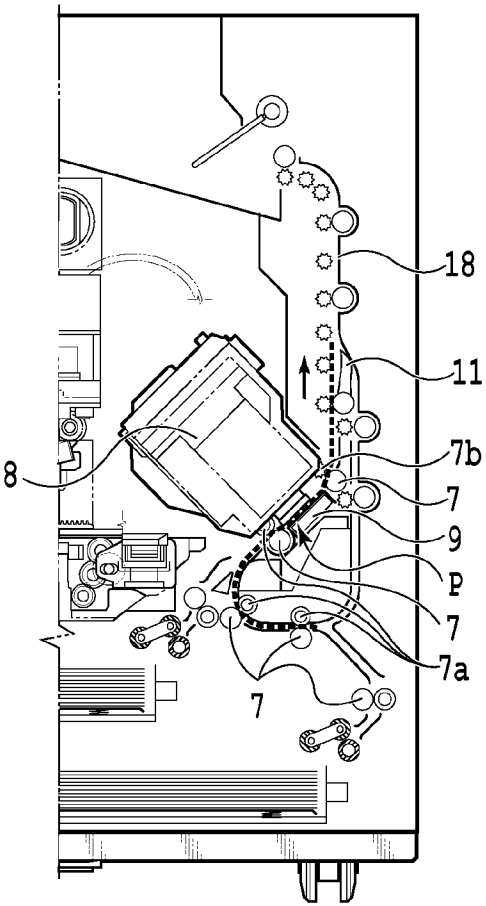
Figure 5A:
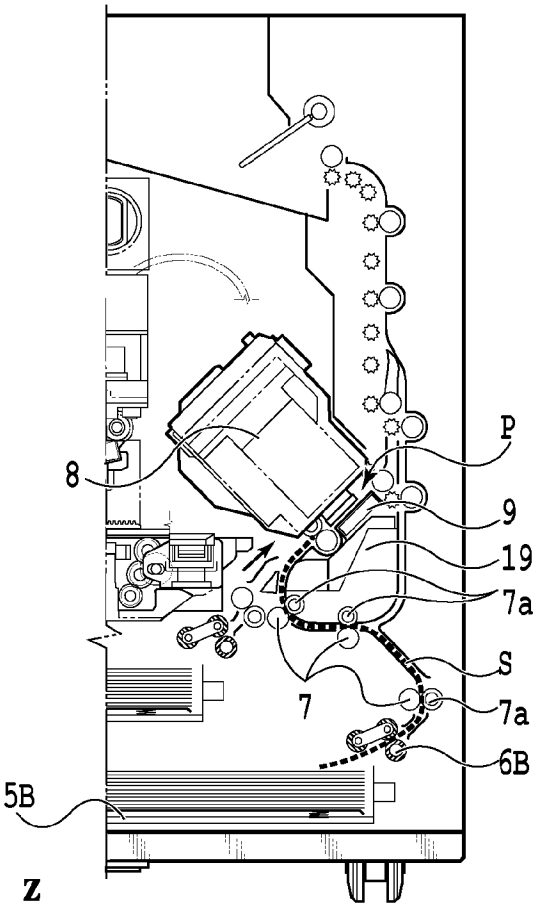

FIGS. 5A to 5C are diagrams showing a conveying path in the case of feeding an A3 size print medium S from the second cassette 5B. A print medium S at the top of a print medium stack in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figures 6A, 6B, 6C, 6D:
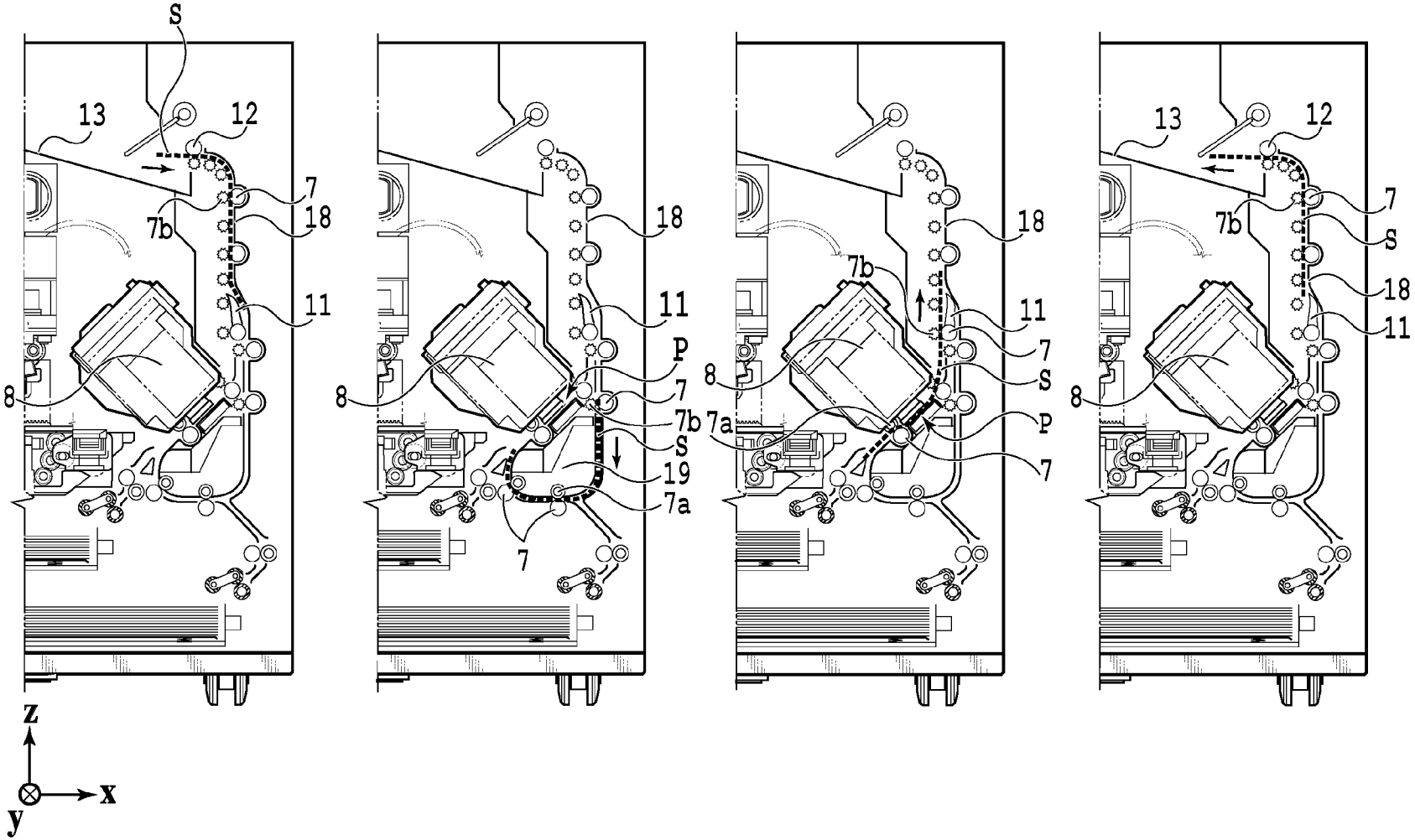
FIGS. 6A to 6D are conveying path diagrams in the case of performing print operation for the back side of a print medium.

After the print head 8 finishes print operation for the first side and the back end of the print medium S passes by the flapper 11, the print controller 202 turns the conveying rollers 7 in reverse to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

<<Maintenance Operation>>

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
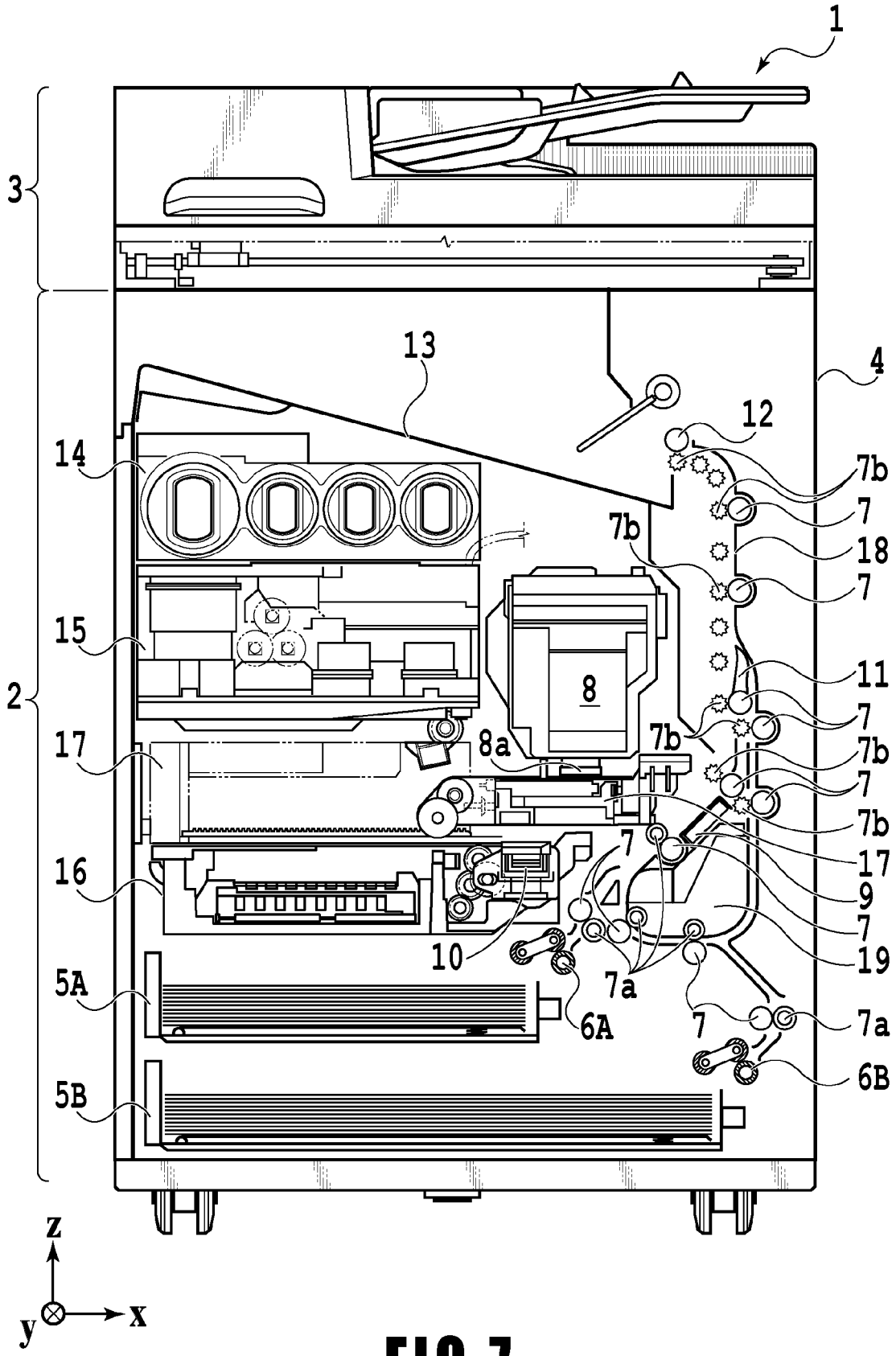
FIG. 7 is a diagram showing the printing apparatus in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed by the maintenance unit 16.

Figure 8A:
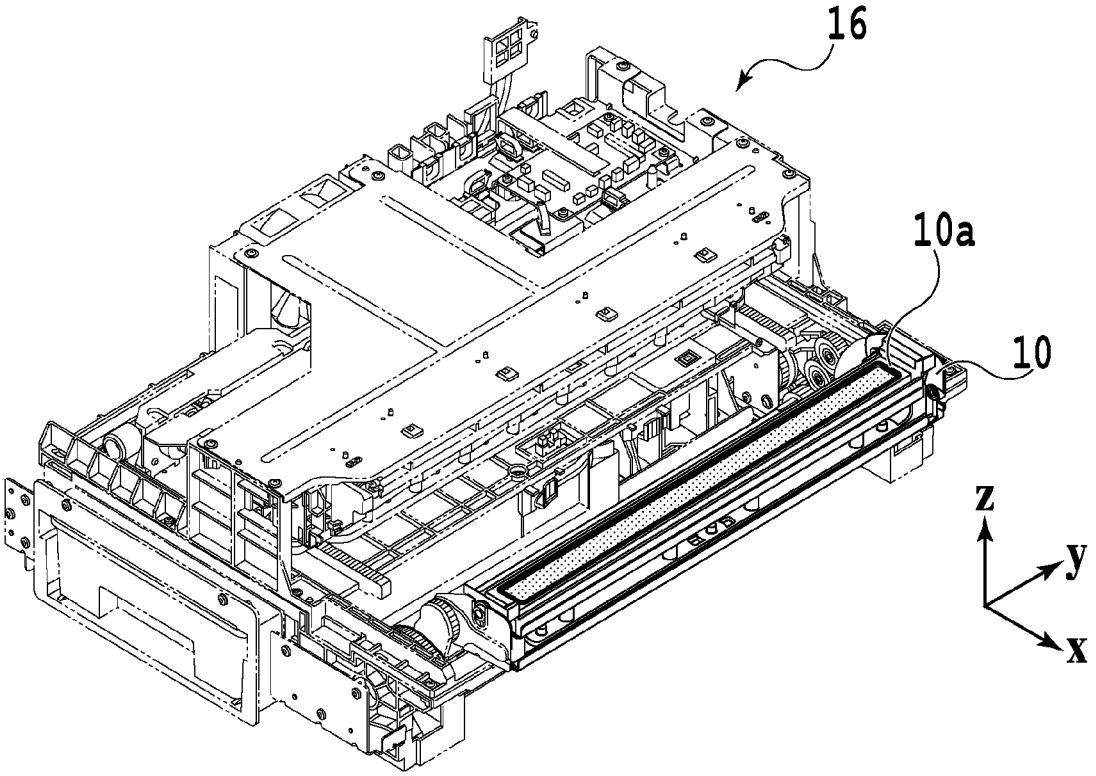
FIGS. 8A and 8B are perspective views showing the configuration of a maintenance unit.
Figure 8B:
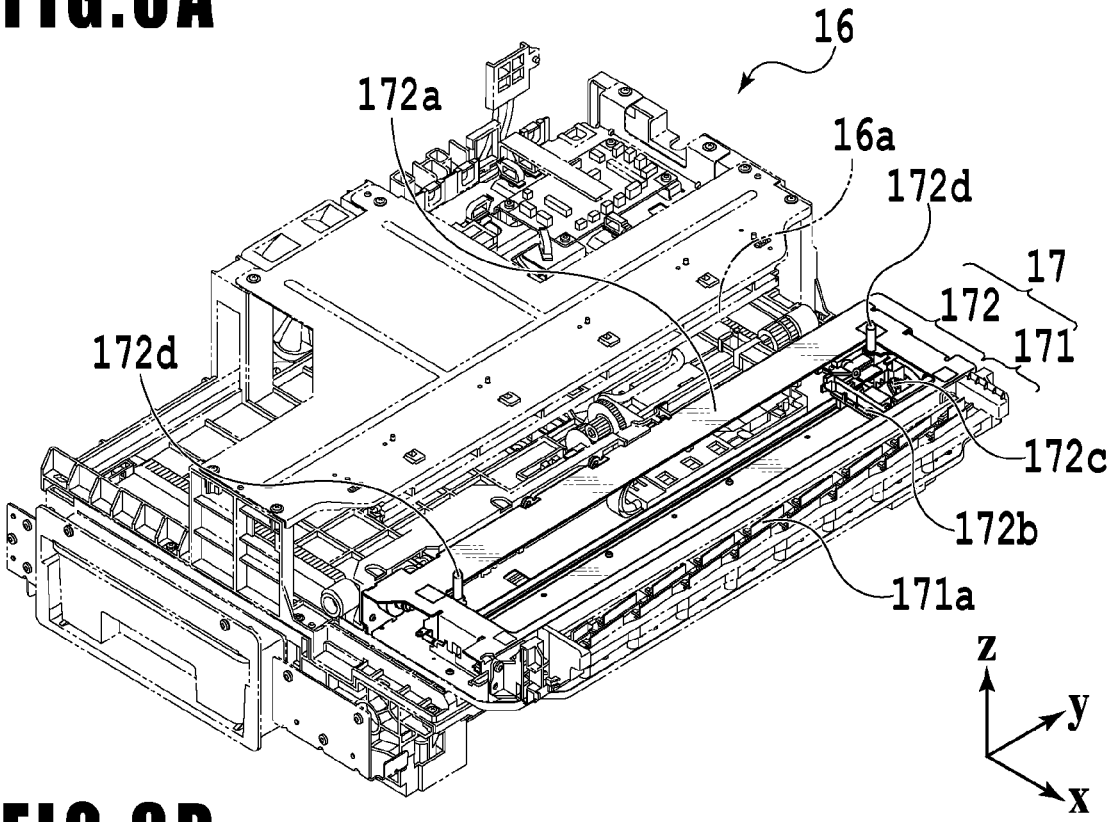

FIG. 8A is a perspective view showing the maintenance unit 16 in a standby position. FIG. 8B is a perspective view showing the maintenance unit 16 in a maintenance position. FIG. 8A corresponds to FIG. 1 and FIG. 8B corresponds to FIG. 7. When the print head 8 is in the standby position, the maintenance unit 16 is in the standby position shown in FIG. 8A, the cap unit 10 has been moved vertically upward, and the wiping unit 17 is housed in the maintenance unit 16. The cap unit 10 comprises a box-shaped cap member 10*a* extending in the y-direction. The cap member 10*a* can be brought into intimate contact with the ejection opening surface 8*a* of the print head 8 to prevent ink from evaporating from the ejection openings. The cap unit 10 also has the function of collecting ink ejected to the cap member 10*a* for preliminary ejection or the like and allowing a suction pump (not shown) to suck the collected ink.

On the other hand, in the maintenance position shown in FIG. 8B, the cap unit 10 has been moved vertically downward and the wiping unit 17 has been drawn from the maintenance unit 16. The wiping unit 17 comprises two wiper units (wiping members): a blade wiper unit 171 and a vacuum wiper unit 172.

In the blade wiper unit 171, blade wipers 171*a* for wiping the ejection opening surface 8*a* in the x-direction are provided in the y-direction by the length of an area where the ejection openings are arrayed. In the case of performing wiping operation by the use of the blade wiper unit 171, the wiping unit 17 moves the blade wiper unit 171 in the x-direction while the print head 8 is positioned at a height at which the print head 8 can be in contact with the blade wipers 171*a*. This movement enables the blade wipers 171*a* to wipe ink and the like adhering to the ejection opening surface 8*a*.

The entrance of the maintenance unit 16 through which the blade wipers 171*a* are housed is equipped with a wet wiper cleaner 16*a* for removing ink adhering to the blade wipers 171*a* and applying a wetting liquid to the blade wipers 171*a*. The wet wiper cleaner 16*a* removes substances adhering to the blade wipers 171*a* and applies the wetting liquid to the blade wipers 171*a* each time the blade wipers 171*a* are inserted into the maintenance unit 16. The wetting liquid is transferred to the ejection opening surface 8*a* in the next wiping operation for the ejection opening surface 8*a*, thereby facilitating sliding between the ejection opening surface 8*a* and the blade wipers 171*a*.

The vacuum wiper unit 172 comprises a flat plate 172*a* having an opening extending in the y-direction, a carriage 172*b* movable in the y-direction within the opening, and a vacuum wiper 172*c* mounted on the carriage 172*b*. The vacuum wiper 172*c* is provided to wipe the ejection opening surface 8*a* in the y-direction along with the movement of the carriage 172*b*. The tip of the vacuum wiper 172*c* has a suction opening connected to the suction pump (not shown). Accordingly, if the carriage 172*b* is moved in the y-direction while operating the suction pump, ink and the like adhering to the ejection opening surface 8*a* of the print head 8 are wiped and gathered by the vacuum wiper 172*c* and sucked into the suction opening. At this time, the flat plate 172*a* and a dowel pin 172*d* provided at both ends of the opening are used to align the ejection opening surface 8*a* with the vacuum wiper 172*c*.

In the present embodiment, it is possible to carry out a first wiping process in which the blade wiper unit 171 performs wiping operation and the vacuum wiper unit 172 does not perform wiping operation and a second wiping process in which both the wiper units sequentially perform wiping operation. In the case of the first wiping process, the print controller 202 first draws the wiping unit 17 from the maintenance unit 16 while the print head 8 is located above the maintenance position shown in FIG. 7 in a vertical direction. The print controller 202 moves the print head 8 vertically downward to a position where the print head 8 can be in contact with the blade wipers 171*a* and then moves the wiping unit 17 into the maintenance unit 16. This movement enables the blade wipers 171*a* to wipe ink and the like adhering to the ejection opening surface 8*a*. That is, the blade wipers 171*a* wipe the ejection opening surface 8*a* when moving from a position drawn from the maintenance unit 16 into the maintenance unit 16.

After the blade wiper unit 171 is housed, the print controller 202 moves the cap unit 10 vertically upward and brings the cap member 10*a* into close contact with the ejection opening surface 8*a* of the print head 8. In this state, the print controller 202 drives the print head 8 to perform preliminary ejection and allows the suction pump to suck ink collected in the cap member 10*a*.

In the case of the second wiping process, the print controller 202 first slides the wiping unit 17 to draw it from the maintenance unit 16 while the print head 8 is located above the maintenance position shown in FIG. 7 in the vertical direction. The print controller 202 moves the print head 8 vertically downward to the position where the print head 8 can be in contact with the blade wipers 171*a* and then moves the wiping unit 17 into the maintenance unit 16. This movement enables the blade wipers 171*a* to perform wiping operation for the ejection opening surface 8*a*. Next, the print controller 202 slides the wiping unit 17 to draw it from the maintenance unit 16 to a predetermined position while the print head 8 is again moved vertically to be located above the maintenance position shown in FIG. 7. Then, the print controller 202 uses the flat plate 172*a* and the dowel pins 172*d* to align the ejection opening surface 8*a* with the vacuum wiper unit 172 while moving the print head 8 down to a wiping position shown in FIG. 7. After that, the print controller 202 allows the vacuum wiper unit 172 to perform the wiping operation described above. After moving the print head 8 vertically upward and housing the wiping unit 17, the print controller 202 allows the cap unit 10 to perform preliminary ejection into the cap member and suction operation of collected ink in the same manner as the first wiping process. <Reason why there is a need for a plurality of relative positions between a print head and a cap unit>

Next, reason why there is a need for specifying a plurality of relative positions between the print head 8 and the cap unit 10 will be described. Specifying a plurality of relative positions allows various aspects of maintenance, as will be described below.

In a first aspect, preliminary ejection of a first ink is performed in a first relative position and preliminary ejection of a second ink which is a type different from the first ink is performed in a second relative position. Preliminary ejection is an operation of discharging ink in a position irrespective of printing (e.g., a position on the cap member 10*a*) to prevent ink from drying or color mixing in ejection openings unused for a predetermined period of time. As described above, the ejection opening surface 8*a* of the print head 8 is capped by coming into close contact with the cap member 10*a* of the cap unit 10. In this state, the print head is driven and the preliminary ejection is performed.

Some inks may easily thicken compared to other inks (e.g., black ink containing pigment in a large amount). In a case where preliminary ejection is performed in a state where a relative position between the print head 8 and the cap unit 10 is fixed (a state where the print head 8 and the cap unit 10 are uniquely positioned), a positional relation between inks preliminarily ejected onto the cap member 10*a* is the same as a positional relation of arrangement of ejection opening arrays. More specifically, ink that may easily thicken continues to be ejected to the same position on the cap member 10*a*. As a result, the ink that may easily thicken sometimes accumulates on the cap member 10*a*. Then, to prevent the preliminarily ejected ink from accumulating on the cap member 10*a*, there is a need for preliminarily ejecting black ink that may easily thicken to an area on the cap member 10*a* where color ink that may not easily thicken has landed. In contrast, there is also a need for preliminarily ejecting color ink, in an overlapping manner, to an area where black ink that may easily thicken has been preliminarily ejected. Incidentally, a location where ink lands by the preliminary ejection is referred to as a "position," and a location of ink that has already landed on the cap member 10*a* is referred to as an "area." This is because ink that has landed may spread across an absorber 115 (see FIG. 18B) and form an area.

In the present embodiment, the print head 8 is a color inkjet print head of a full-line type and has ejection opening arrays extending in a manner corresponding to a width of a print medium S. Ejection opening arrays of respective inks align in a first direction (x-direction) crossing a direction in which the ejection opening arrays extend. The cap member 10*a* is a member extending in the y-direction so as to cover the ejection opening arrays. In a case where it is intended that a position in which preliminarily ejected black ink lands overlaps with an area on the cap member 10*a* where color ink has landed, it is needed to specify a plurality of relative positions between the print head 8 and the cap member 10*a* in the first direction (x-direction). More specifically, there is a need for locating the print head 8 and the cap unit 10 in different positions in the first direction.

In a second aspect, a position of capping is different from a position of preliminary ejection. For example, capping and suction are performed in the first relative position, and preliminary ejection of a specified color is performed in the second relative position.

In a third aspect, capping is performed in a plurality of positions. For example, capping is performed in various positions depending on a position of the print head 8 at the time of movement of the cap unit 10 to a capping position. More specifically, there is an aspect that in a case where the cap unit 10 has a plurality of capping positions, the cap unit 10 moves to a capping position to which the cap unit 10 moves in a shorter distance. There is also an aspect that a capping position in a standby state in which a capping state is maintained is different from a capping position at the time of performing suction operation.

In the following embodiment, with the example of the above-described first aspect, that is, the aspect of performing preliminary ejection in different positions, an aspect of specifying a plurality of relative positions between the print head 8 and the cap unit 10 will be described.

<Positioning of the Print Head and the Cap Unit>

A configuration of a positioning portion for determining a relative position between the print head 8 and the cap unit 10 will be described.

Figure 9A:
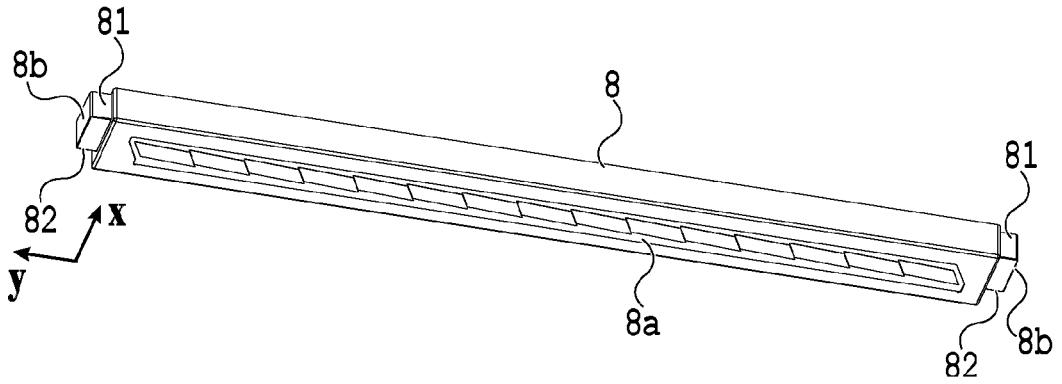
FIGS. 9A and 9B are diagrams illustrating a positioning portion.
Figure 9B:
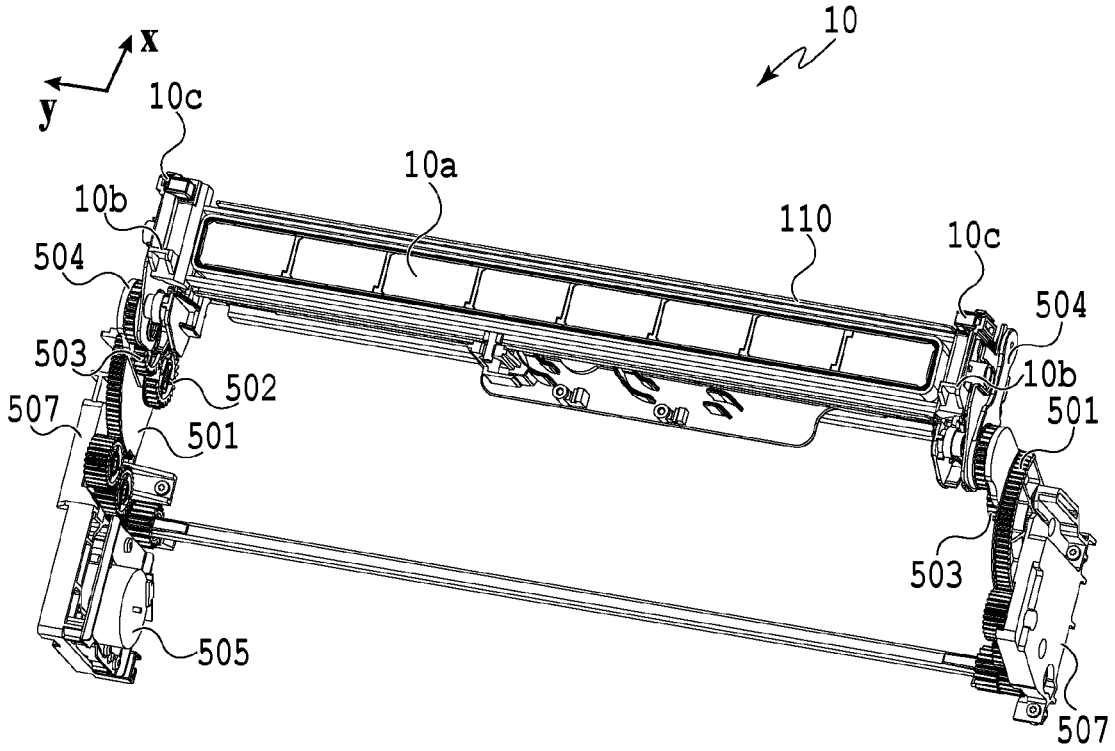

FIGS. 9A and 9B are diagrams illustrating the positioning portion for determining a relative position between the print head 8 and the cap unit 10. FIG. 9A is a partial perspective view including the ejection opening surface 8*a* of the print head 8. FIG. 9B is a perspective view of the cap unit 10.

As shown in FIG. 9A, both ends of the print head 8 in a longitudinal direction (y-direction) have a positioning member 8*b* used as the positioning portion. In the present embodiment, a surface formed on the positioning member 8*b* in the first direction (x-direction) is used as a positioning surface of the print head 8.

The cap unit 10 shown in FIG. 9B has a cap holder 110. The cap holder 110 has the cap member 10*a*. Further, in the cap holder 110, both ends of the cap member 10*a* in the longitudinal direction (y-direction) have a first positioning member 10*b* and a second positioning member 10*c* used as the positioning portions. As shown in FIG. 9B, in the x-direction of the cap unit 10, the first positioning member 10*b* is provided on a side of evacuation of the cap unit 10 (on the left side of FIG. 1). In the x-direction of the cap unit 10, the second positioning member 10*c* is provided in a position facing the first positioning member 10*b*. That is, the second positioning member 10*c* is provided on the right side of FIG.

1. In the present embodiment, the first positioning member 10*b* is a fixed member and the second positioning member 10*c* is a movable member.

The distance between the first positioning member 10*b* and the second positioning member 10*c* in the first direction (x-direction) is greater than the length of the positioning member 8*b* of the print head 8 in the first direction (x-direction). Accordingly, the positioning member 8*b* of the print head 8 can enter a gap between the first positioning member 10*b* and the second positioning member 10*c*. Then, controlling movement of the cap unit 10 (cap member 10*a*) in the first direction (x-direction) allows locating a plurality of relative positions. That is, it is possible to achieve the first relative position where the first positioning surface 81 of the positioning member 8*b* of the print head 8 comes into contact with the first positioning member 10*b* of the cap unit 10. It is also possible to achieve the second relative position where the second positioning surface 82 (a surface opposite to the first positioning surface 81) of the positioning member 8*b* of the print head 8 comes into contact with the second positioning member 10*c* of the cap unit 10. In this manner, in the present embodiment, positioning is performed by using the first positioning member 10*b* and the second positioning member 10*c* provided on both ends of the cap holder 110 in the y-direction and the positioning member 8*b* provided on both ends of the print head 8 in the y-direction.

<Regarding Movement of the Cap Unit>

FIGS. 10A to 10D are diagrams illustrating the cap unit 10. With reference to FIGS. 10A to 10D, an example that the cap unit 10, while keeping its horizontal state, moves from the evacuation position shown in FIG. 3 to the capping position shown in FIG. 1 will be described.

Figure 10B:
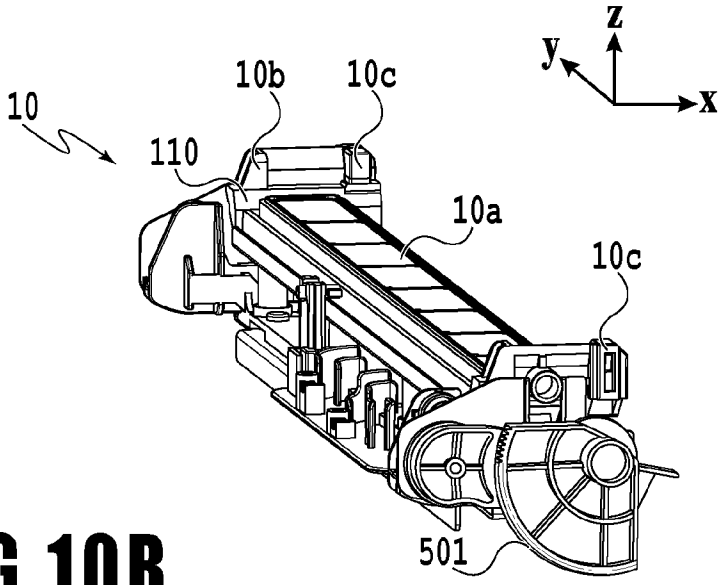
FIGS. 10A to 10D are diagrams illustrating a cap unit.
Figure 10D:
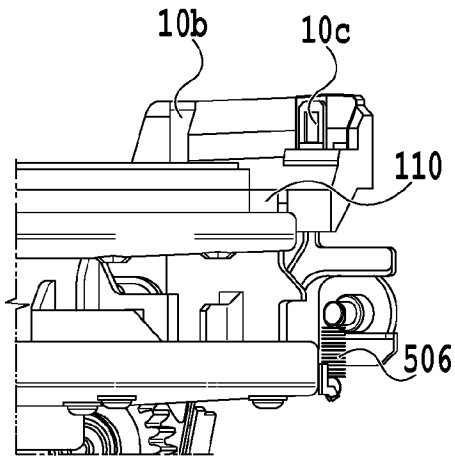
Figure 10A:
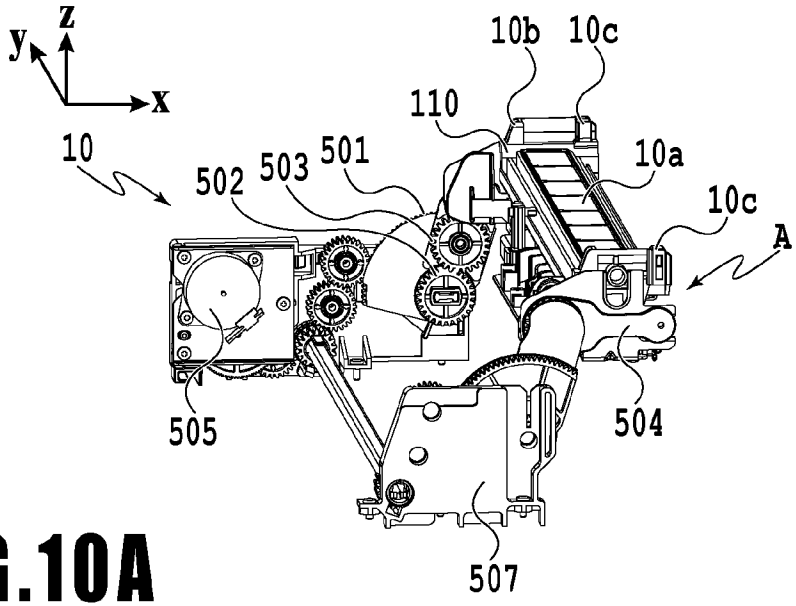
Figure 10C:
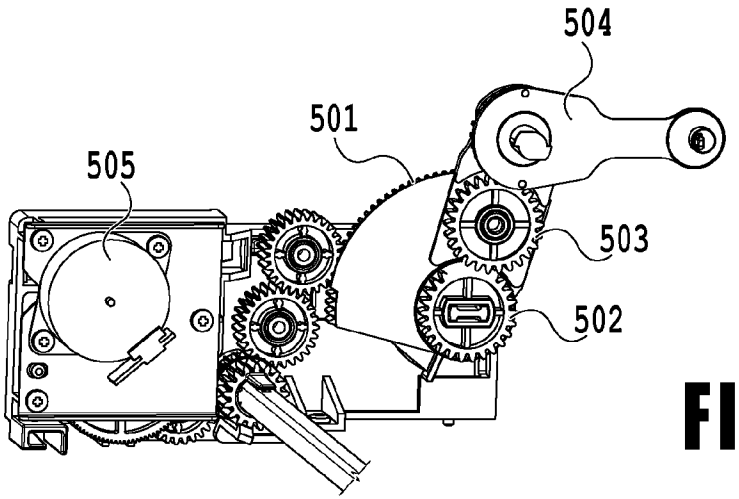

FIG. 10A shows that the cap unit 10 has moved to the capping position shown in FIG. 1. FIG. 10B shows that the cap unit 10 has moved to the evacuation position shown in FIG. 3. FIG. 10C is a diagram showing an example of a gear train of the cap unit 10. FIG. 10D is a partial enlarged view of the cap unit 10 as viewed in an arrow A direction of FIG. 10A.

As shown in FIGS. 10A and 10C, the cap unit 10 has a gear train including a sector gear 501, a first gear 502, a second gear 503, and a cap holder gear 504. Gear trains are provided symmetrically on the front (a front side in FIGS. 10A and 10B) and the back (on a back side in FIGS. 10A and 10B) of the apparatus. The gear train on the front and the gear train on the back are simultaneously driven by a drive motor 505.

In the present embodiment, the center of the sector gear 501 and the center of the first gear 502 are the same. Further, the sector gear 501 is rotatably held by a base member 507 and the first gear 502 is unrotatably fixed to the base member 507. The cap holder gear 504 and the second gear 503 are rotatably held by the sector gear 501 and the second gear 503 is coupled to both of the first gear 502 and the cap holder gear 504. Furthermore, the gear ratio (the number of teeth) of the first gear 502 and the gear ratio of the cap holder gear 504 are the same.

In a case where the sector gear 501 rotates in this configuration, the first gear 502 does not rotate, and thus the second gear 503 that engages with the first gear 502 revolves together with the sector gear 501, while rotating around the first gear 502. In this example, since the first gear 502 and the cap holder gear 504 have the same gear ratio (the number of teeth), they have the same number of rotations. Accordingly, the cap holder gear 504 rotates in reverse for the same angle as the rotation of the sector gear 501, and the attitude of the cap holder gear 504 is constant irrespective of the angle of the sector gear 501. In this manner, in the configuration of the present embodiment, the cap holder 110 can move while keeping its horizontal state.

Incidentally, rotation by the gear causes a free end side of the cap holder gear 504 to hang and easily tilt due to impact of backlash, weight of the cap holder 110, or the like. Then, to hold the attitude of the cap unit 10, the free end side is biased upward in a gravity direction by using a spring 506 (urging member) of FIG. 10D and lifted. At the time of capping, the print head 8 presses the cap holder 110 against the base member (not shown) of the maintenance unit 16, and the attitude of the cap holder 110 is fixed.

A driving amount of the drive motor 505 is controlled by the maintenance control unit 210, and the maintenance control unit 210 controls the driving amount in response to an instruction from the print controller 202.

<Outline of Movement Sequence>

Next, the outline of a movement sequence for moving the print head 8 and the cap unit 10 will be described. FIGS. 11A to 11C, FIGS. 12A to 12C, and FIGS. 13A and 13B are diagrams illustrating the outline of movement of the cap unit 10. Like FIG. 1 and others, these figures are schematic diagrams of the front of the apparatus and schematically show relevant portions. They also show the gears partially in a transparent state.

Figure 11A:
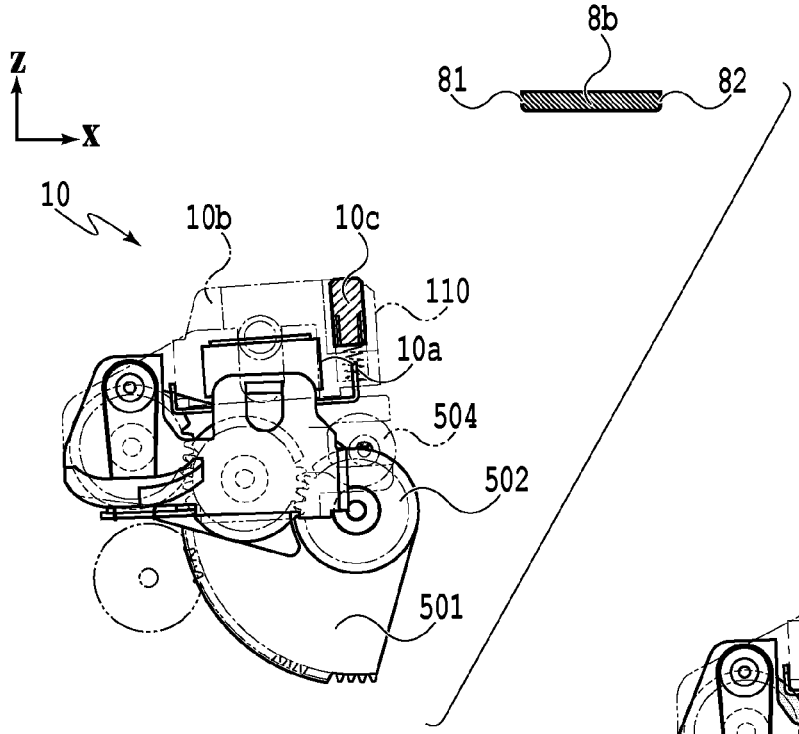
FIGS. 11A to 11C are diagrams illustrating the outline of movement of the cap unit.
Figure 11B:
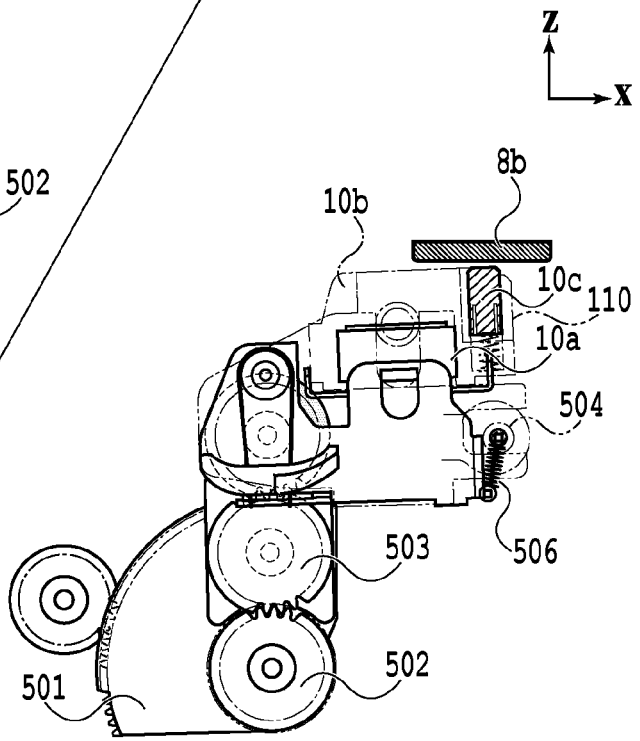
Figure 11C:
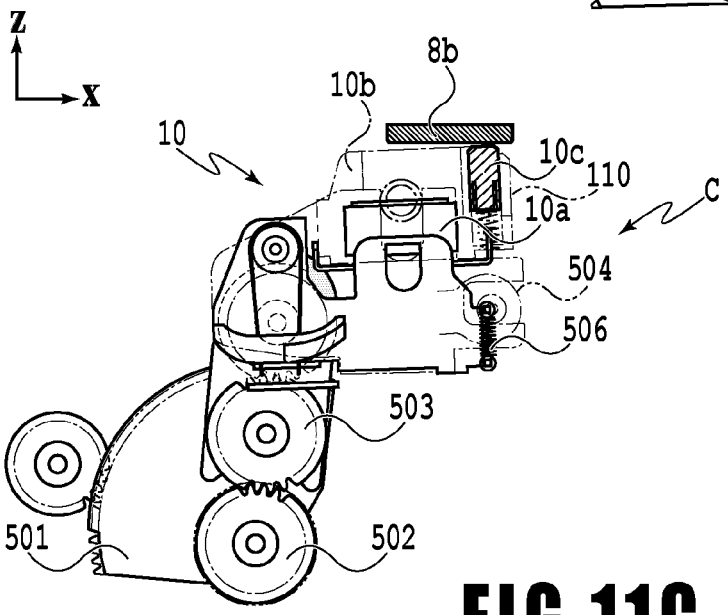

FIG. 11A shows that the sector gear has rotated from the evacuation position shown in FIG. 3 and the cap holder 110 has slightly moved up. The print head 8 (FIG. 11A shows the positioning member 8*b* of the print head; the same applies to FIGS. 12A to 12C and FIGS. 13A and 13B) that has been inclined about 45 degrees with respect to the horizontal direction is in an attitude in which the ejection opening surface 8*a* faces downward in the vertical direction. FIG. 11B shows that, after the state of FIG. 11A, the sector gear 501 has rotated clockwise in FIG. 11A, thereby locating the cap holder 110 below the print head 8 in the vertical direction. FIG. 11C shows that, after the state of FIG. 11B, the sector gear 501 has further rotated and reached a cap preparation position. The cap preparation position refers to a position of the cap unit 10 at the start of moving down of the print head 8.

Figure 12A:
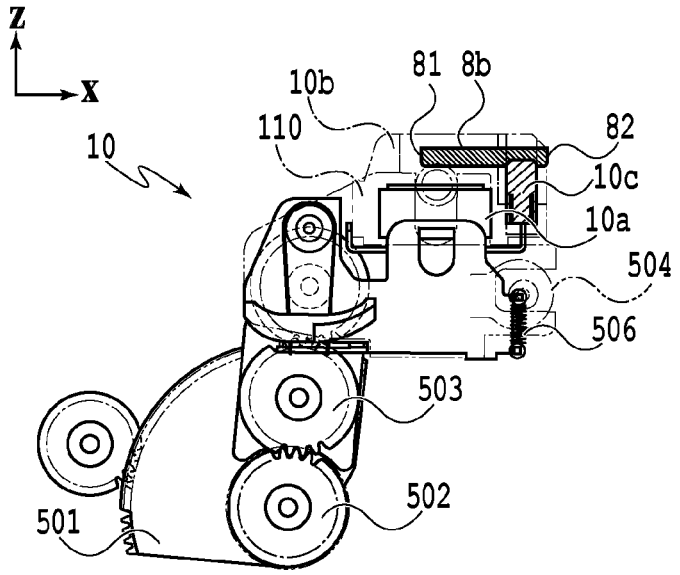
FIGS. 12A to 12C are diagrams illustrating the outline of movement of the cap unit.
Figure 12B:
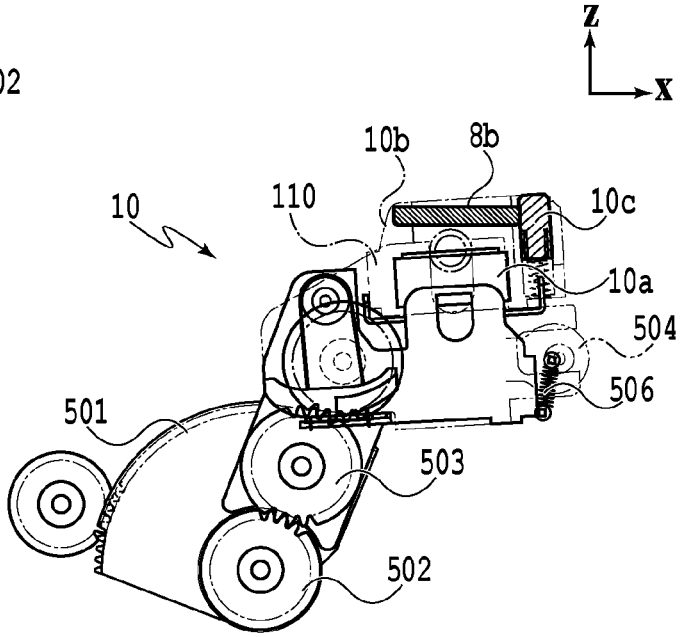
Figure 12C:
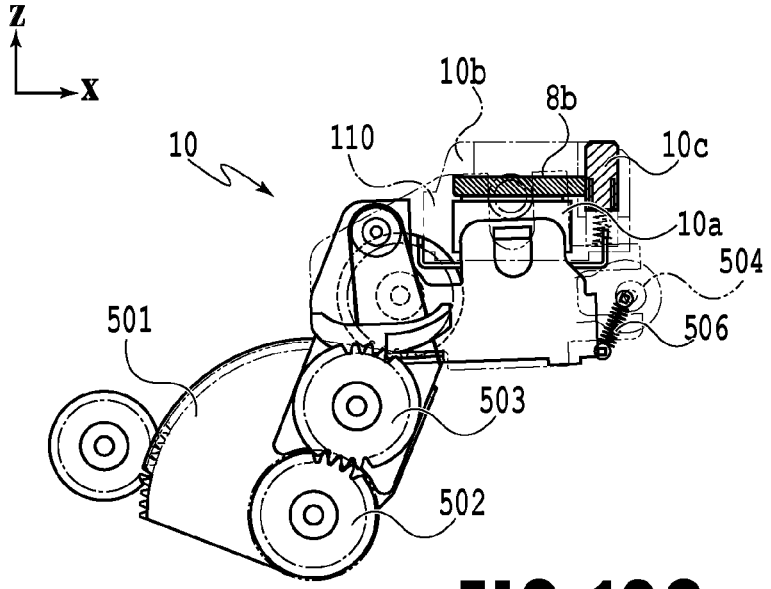

FIG. 12A shows that, after the cap unit 10 has reached the cap preparation position, the print head 8 has moved down. That is, FIG. 12A shows that, after the state of FIG. 11C, the head carriage control unit 208 has caused the print head 8 to move down in response to an instruction from the print controller 202. FIG. 12B shows that, after the print head 8 has moved down, the sector gear 501 has further rotated, thereby bringing the first positioning surface 81 of the positioning member 8*b* and the first positioning member 10*b* of the cap holder 110 into contact with each other. That is, FIG. 12B shows the first relative position in which the first positioning surface 81 of the positioning member 8*b* of the print head 8 is in contact with the first positioning member 10*b* of the cap holder 110. FIG. 12C shows a state where the print head 8 has moved down after the state of FIG. 12B, thereby causing the print head 8 to be pressed against the cap member 10*a*, that is, a state where capping is performed. The state of FIG. 12C may be the first relative position.

Figure 13A:
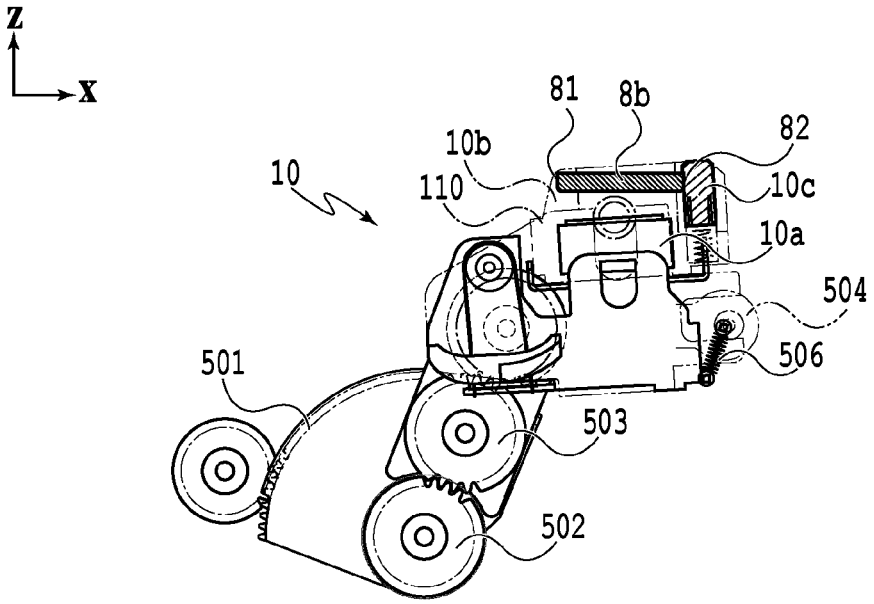
FIGS. 13A and 13B are diagrams illustrating the outline of movement of the cap unit.
Figure 13B:
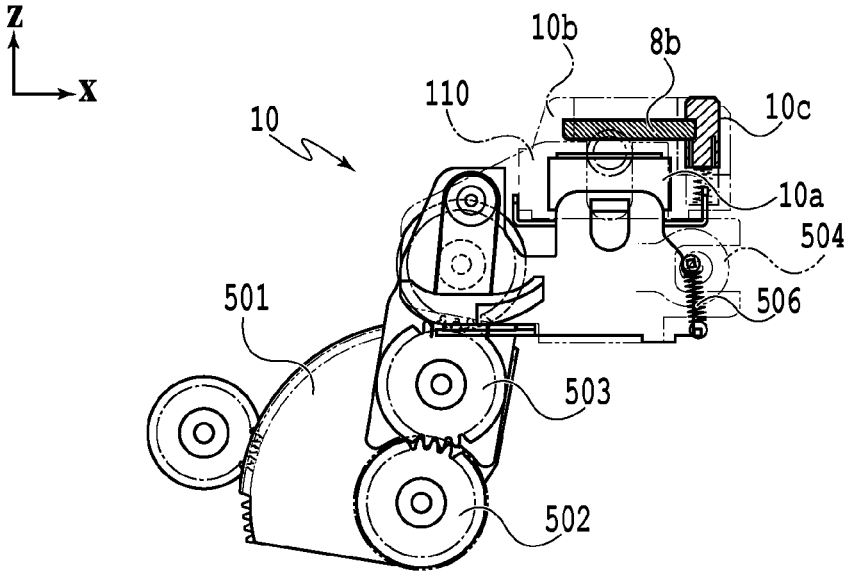

FIG. 13A shows that, after the state of FIG. 12C, the print head 8 has moved up. FIG. 13B shows a state where the sector gear 501 has rotated in a direction opposite to the direction described above (counterclockwise in FIG. 13A), thereby bringing the second positioning surface 82 of the positioning member 8*b* and the second positioning member 10*c* of the cap holder 110 into contact with each other in the horizontal direction. That is, FIG. 13B shows the second relative position in which the second positioning surface 82 of the positioning member 8*b* of the print head 8 is in contact with the second positioning member 10*c* of the cap holder 110. The outline of the movement sequence has been described above.

<Control of Movement to the First Relative Position>

Next, a movement sequence for movement of the print head 8 and the cap unit 10 to the first relative position will be described in detail.

Figure 14:
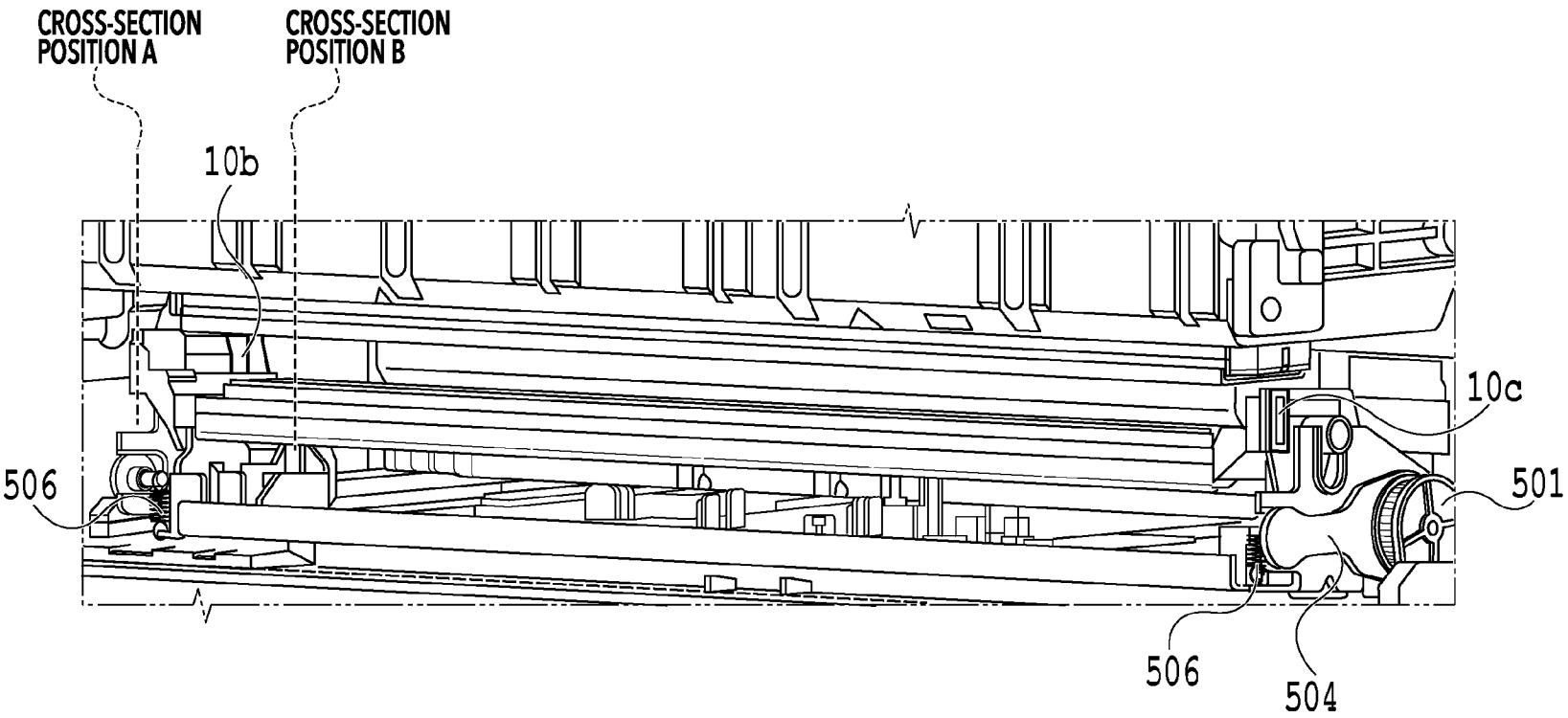
FIG. 14 is a perspective view of a cap preparation position.

FIG. 14 is a partial perspective view of a state where the cap unit 10 is located in the cap preparation position of FIG. 11C. FIG. 14 is a view from an arrow C direction of FIG. 11C. Hereinafter, movement control will be described with reference to mainly a cross-sectional view in a cross-section position A and a cross-sectional view in a cross-section position B. It should be noted that the cross-section position A is a cross section including the positioning member 8*b* and the positioning members 10*b*, 10*c*. The cross-section position B shows a cross section near the center of the print head 8 (or the cap unit 10) in the longitudinal direction compared to the cross-section position A, which cross section does not include the positioning member 8*b* and the positioning members 10*b*, 10*c* but includes ejection openings.

Figure 15A:
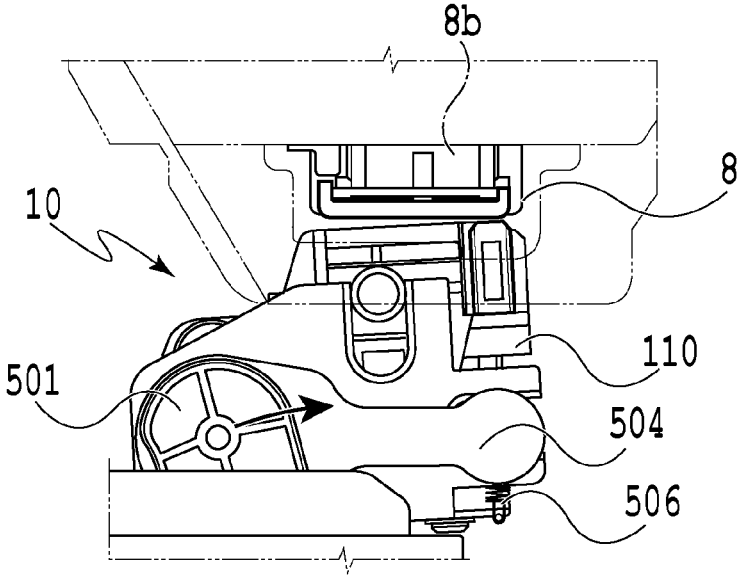
FIGS. 15A and 15B are enlarged views of the vicinity of the cap holder in the cap preparation position.
Figure 15B:
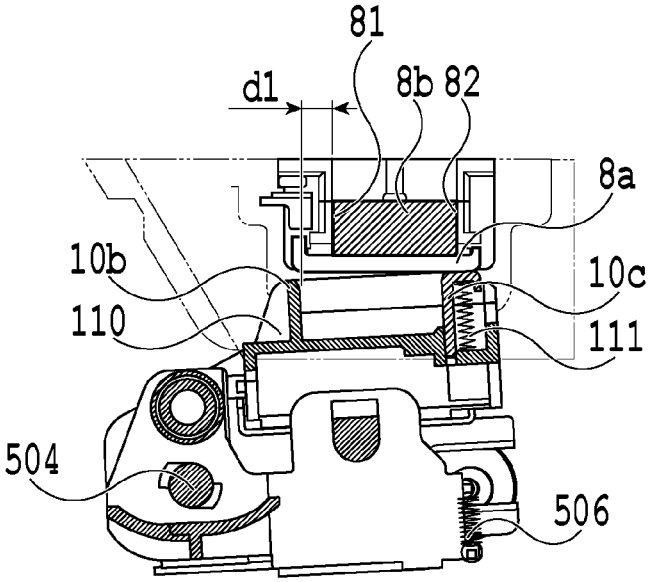

FIG. 15A is an enlarged view of the vicinity of the cap holder 110 in the cap preparation position of FIG. 11C. If the cap unit 10 reaches the cap preparation position, the maintenance control unit 210 stops the drive motor 505 to stop rotation of the sector gear 501. Accordingly, the movement of the cap unit 10 stops. FIG. 15B is a cross-sectional view in the cross-section position A in the cap preparation position of FIG. 15A. There is a gap having a distance d1 between the first positioning surface 81 of the positioning member 8*b* and the first positioning member 10*b* of the cap holder 110. This gap is provided to prevent the positioning member 8*b* of the print head from coming into contact with the first positioning member 10*b* in a case where the print head 8 moves down. Furthermore, the positioning member 8*b* of the print head 8 at this time is located above the second positioning member 10*c* (movable member) of the cap holder 110 in the vertical direction. The second positioning member 10*c* is provided with a spring 111, which is a movable member configured to move in the vertical direction. Accordingly, in a case where the print head 8 moves down and the positioning member 8*b* abuts on the second positioning member 10*c*, the second positioning member 10*c* moves downward in the vertical direction according to the moving down of the print head 8, and is evacuated.

In this manner, reason why the second positioning member 10*c* is configured to be a movable member is that there may be a case where a movement amount (displacement amount) between the first relative position and the second relative position is small. For example, it is assumed that a movement amount between the first relative position and the second relative position is 3 mm. Now, with the assumption that the second positioning member 10*c* is a fixed member, depending on the accuracy of stopping of the cap unit 10 in the cap preparation position, moving down of the print head 8 may result in a collision with the second positioning member 10*c*. Since configuring the second positioning member 10*c* to be a movable member allows the positioning member 10*c* to be evacuated according to the moving down of the print head 8, it is possible to prevent the print head 8 and the second positioning member 10*c* from coming into collision with each other.

Figure 16:
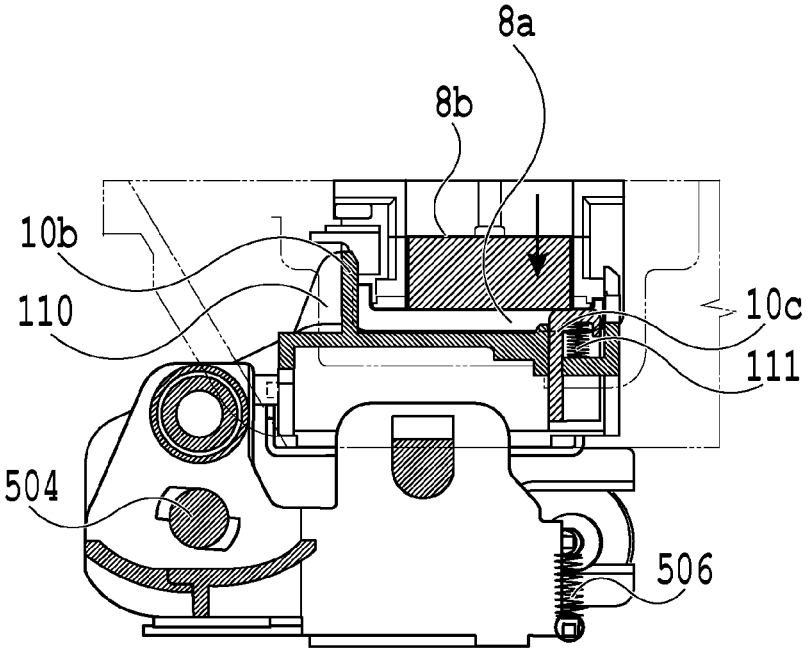
FIG. 16 is a cross-sectional view of the vicinity of the cap holder.

FIG. 16 is a cross-sectional view in the cross-section position A in the state of FIG. 12A. That is, FIG. 16 shows that, after the cap unit 10 has reached the cap preparation position, the head carriage control unit 208 has caused the print head 8 to move down in response to an instruction from the print controller 202. By the moving down of the print head 8, the positioning member 8*b* comes into contact with the second positioning member 10*c* of the cap holder 110 in the vertical direction. Furthermore, according to the moving down of the print head 8, the second positioning member 10*c* of the cap holder 110 is forced in the vertical direction.

Figure 17:
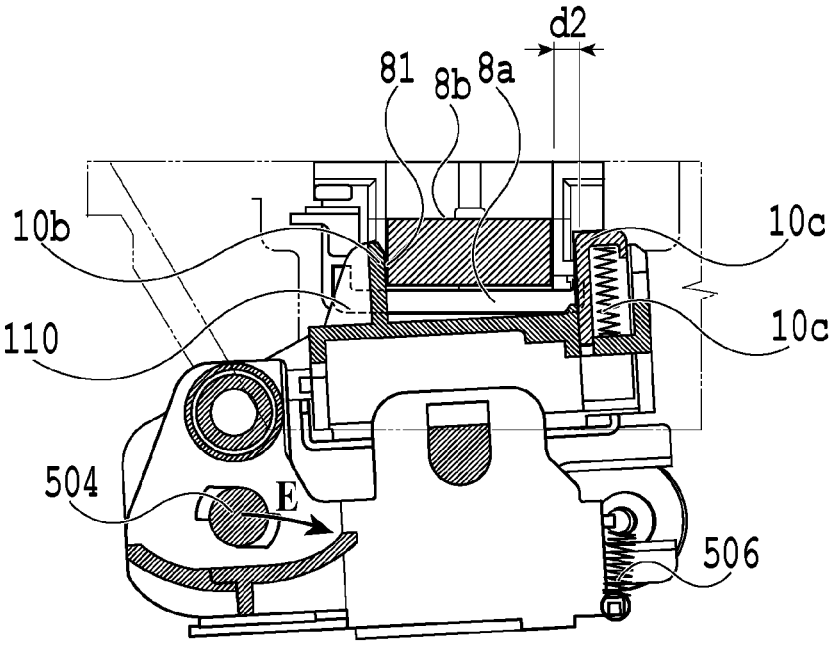
FIG. 17 is a cross-sectional view of the vicinity of the cap holder.

FIG. 17 is a cross-sectional view in the cross-section position A in the state of FIG. 12B. That is, FIG. 17 shows that, after the print head 8 has moved down, the sector gear 501 has further rotated, thereby bringing the positioning member 8*b* of the print head and the first positioning member 10*b* of the cap holder 110 into contact with each other. As shown in FIG. 17, the position of the cap holder 110 moves in an arrow E direction of FIG. 17 depending on the rotation of the sector gear 501. Accordingly, as shown in a distance d2, the positioning member 8*b* of the print head 8 is separated from the second positioning member 10*c* (movable member) of the cap holder 110, thereby producing a gap. Therefore, the spring that has been forced returns to its original state, and the second positioning member 10*c* returns to the state before the spring is forced. FIG. 17 shows the first relative position in which the first positioning surface 81 of the positioning member 8*b* of the print head 8 comes into contact with the first positioning member 10*b* of the cap unit 10.

Figure 18A:
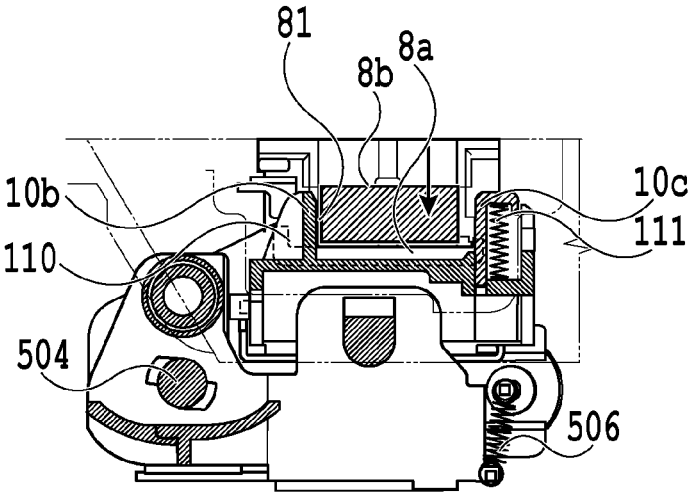
FIGS. 18A and 18B are cross-sectional views of the vicinity of the cap holder.
Figure 18B:
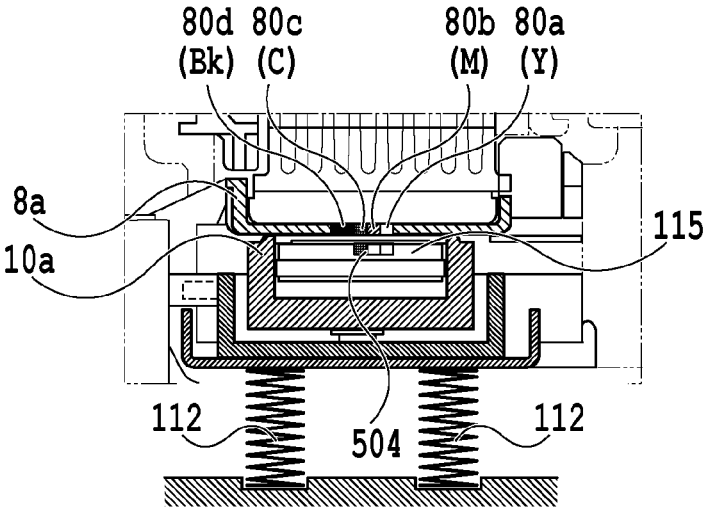

FIG. 18A is a cross-sectional view in the cross-section position A in the state of FIG. 12C. FIG. 18B is a cross-sectional view in the cross-section position B in the state of FIG. 12C. That is, FIGS. 18A and 18B show a state where the print head 8 has moved down and capping is performed. As shown in FIG. 18A, by the moving down of the print head 8, the ejection opening surface 8*a* comes into contact with the cap member 10*a*, and the cap holder 110 is also pressed down to a predetermined position. As shown in FIG. 18B, a lower part of the cap holder 110 is provided with a cap spring 112 for causing the cap holder 110 to be pressed against the ejection opening surface 8*a* of the print head 8 under a predetermined pressure. A reaction force of the cap spring 112 causes the cap holder 110 to come into contact with the base member of the maintenance unit 16.

A relative position between the print head 8 and the cap unit 10 in FIGS. 18A and 18B in the first direction (x-direction) is the same as the position of FIG. 17. Accordingly, FIGS. 18A and 18B also show a state where the print head 8 and the cap unit 10 are in the first relative position. In this state, as shown in FIG. 18B, the print controller 202 causes the print head 8 to perform preliminary ejection of color ink. The ejection opening surface 8*a* of the print head 8 is provided with ejection openings 80*a*, 80*b*, 80*c*, 80*d* corresponding to ejection opening arrays of yellow, magenta, cyan, and black inks, respectively. In the first relative position, preliminary ejection of color inks other than black ink is performed from the ejection openings 80*a* to 80*c*. The preliminarily ejected ink is absorbed by the cap absorber 115.

<Control of Movement to the Second Relative Position>

Next, control of movement of the print head 8 and the cap unit 10 from the first relative position to the second relative position will be described.

Figure 19:
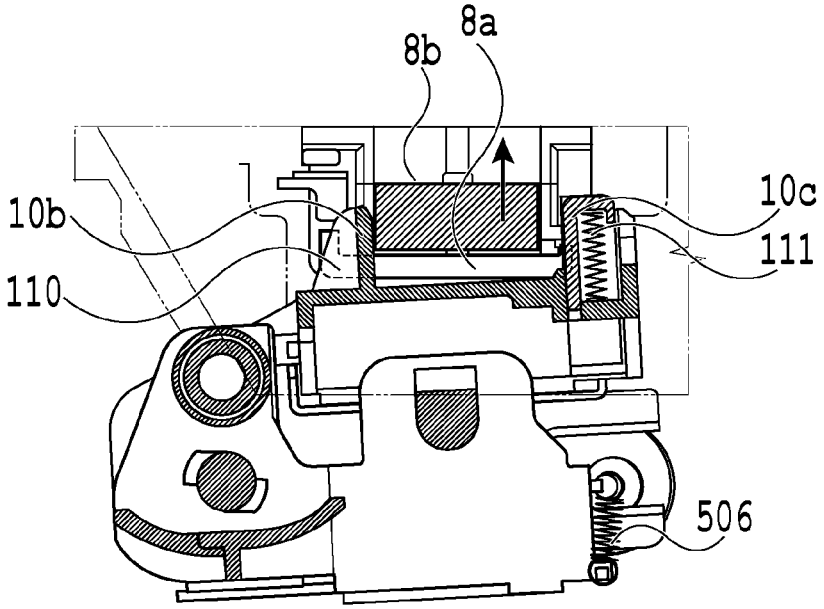
FIG. 19 is a cross-sectional view of the vicinity of the cap holder.

FIG. 19 is a cross-sectional view in the cross-section position A in the state of FIG. 13A. That is, FIG. 19 shows that, after the state of FIGS. 18A and 18B, the print head 8 has moved up. In FIG. 19, the ejection opening surface 8*a* of the print head is separated from the cap member 10*a*.

Figure 20A:
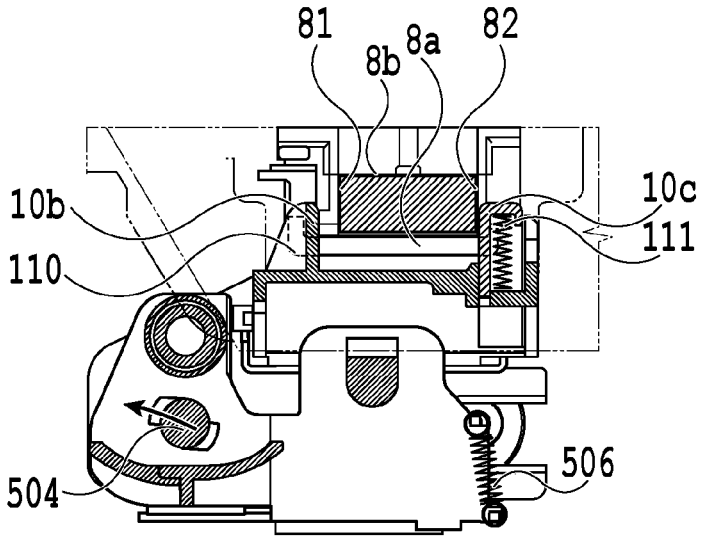
FIGS. 20A and 20B are cross-sectional views of the vicinity of the cap holder.
Figure 20B:
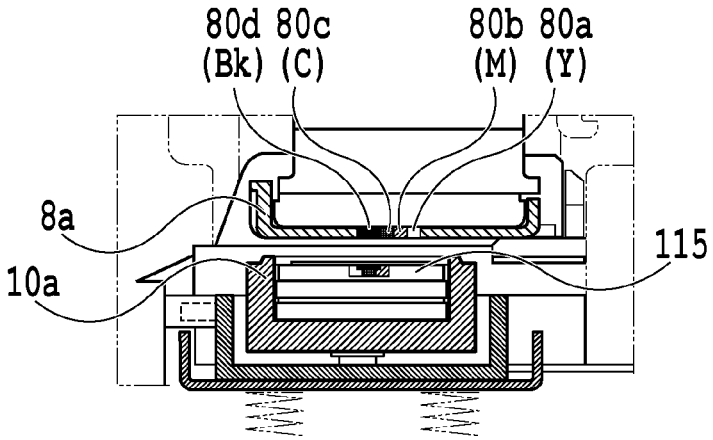

FIG. 20A is a cross-sectional view in the cross-section position A in the state of FIG. 13B and FIG. 20B is a cross-sectional view in the cross-section position B in the state of FIG. 13B. That is, FIGS. 20A and 20B show a state where the sector gear has rotated in a direction opposite to the direction described above, thereby bringing the positioning member 8*b* of the print head and the second positioning member 10*c* of the cap holder 110 into contact with each other in the horizontal direction. As shown in FIG. 20A, the second relative position is achieved in which the second positioning surface 82 of the positioning member 8*b* of the print head 8 is in contact with the second positioning member 10*c* of the cap holder 110 in the horizontal direction. As shown in FIG. 20B, if preliminary ejection of black ink is performed in the second relative position from the ejection openings 80*d*, the black ink lands, in an overlapping manner, within an area where preliminarily ejected color ink has landed.

It should be noted that in the example of FIG. 20B, description has been given of the example of the case where preliminary ejection is performed in a state where the ejection opening surface 8*a* of the print head 8 is separated from the cap member 10*a*. However, the present invention is not limited to this. The preliminary ejection may be performed in a state where the print head 8 further moves down and the ejection opening surface 8*a* and the cap member 10*a* are in contact with each other and capped. That is, the state where the print head 8 is capped may also be a state where the print head 8 and the cap unit 10 are located in the second relative position. It should be noted that also in the case where color ink is preliminarily ejected as described above with reference to FIG. 18B, the preliminary ejection may be performed, not in the capping state, but in a state where the ejection opening surface 8*a* of the print head 8 is separated from the cap member 10*a*.

As described above, according to the present embodiment, the print head 8 and the cap unit 10 may be located in different positions in the first direction (x-direction) crossing the ejection opening array. Therefore, it is possible to satisfy the need for specifying a plurality of relative positions between the print head 8 and the cap unit 10.

It should be noted that in the above-described embodiment, description has been given of the example of the aspect that the first positioning member 10*b* of the cap unit 10 is a fixed member and the second positioning member 10*c* is a movable member. However, the present invention is not limited to this. The first positioning member 10*b* may be a movable member and the second positioning member 10*c* may be a fixed member. Alternatively, the first positioning member 10*b* and the second positioning member 10*c* may be movable members. In a case where a movement amount (displacement amount) between the first relative position and the second relative position is great to an extent that there is no need to consider the accuracy of movement of the print head 8 and the cap unit 10, the first positioning member 10*b* and the second positioning member 10*c* may be fixed members.

In the above-described embodiment, description has been given of the example of the aspect that the positioning member 8*b* of the print head 8 and the positioning members 10*b*, 10*c* of the cap unit 10 are symmetrically provided on both ends in the longitudinal direction. That is, description has been given of the example that two positioning members 8*b* have the same size and the distances between the opposing positioning member 10*b* and positioning member 10*c* have the same length. However, the shape and size of one end in the longitudinal direction of the print head 8 and the cap unit 10 may be different from the shape and size of the other end. In this case, at each end, the positioning members 8*b*, 10*b*, 10*c* may have appropriate sizes and shapes depending on the movement amount in achieving the first relative position and the second relative position.

Second Embodiment

In the first embodiment, description has been given of the aspect that a second positioning portion (first positioning member 10*b*) of the cap unit 10 comes into contact with a first positioning portion (first positioning surface 81) of the print head 8 in the first relative position. Further, description has been given of the aspect that a fourth positioning portion (second positioning member 10*c*) of the cap unit 10 comes into contact with a third positioning portion (second positioning surface 82) of the print head 8 in the second relative position. That is, description has been given of the aspects that different portions of the print head 8 come into contact with different portions of the cap unit 10 in the respective relative positions.

In the present embodiment, description will be given of an aspect that a plurality of relative positions are achieved by the positioning portions at different portions of the cap unit 10 with respect to the positioning portion at one location of the print head 8.

Figure 21:
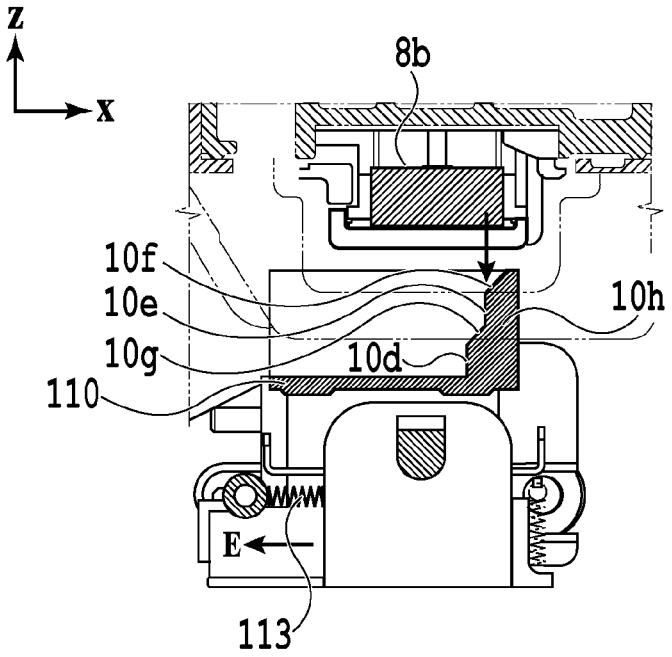
FIG. 21 is a diagram illustrating an example of a positioning member.

FIG. 21 is a diagram showing a cross section in the cross-section position A of FIG. 14 like the example described in the first embodiment. In the present embodiment, the cap holder 110 is different from the one in the first embodiment. In the cap holder 110 of the present embodiment, a positioning member 10*h* at one end in the x-direction is configured to have a plurality of steps. More specifically, a thickness of the positioning member 10*h* in the x-direction is configured to increase in stages toward a lower portion of the cap holder 110. Furthermore, between the steps, an inclined surface is formed. In the present embodiment, as shown in FIG. 21, the positioning member 10*h* of the cap holder 110 is provided with a first positioning surface 10*d*, a second positioning surface 10*e*, a first inclined surface 10*f*, and a second inclined surface 10*g*. Further, the cap unit 10 has a cap holder spring 113, and the cap unit 10 (including the cap holder 110) is biased in an arrow E direction of FIG. 21 by the cap holder spring 113 (to the left). FIG. 21 is a diagram showing a cap preparation position of the present embodiment. The cap preparation position of the present embodiment is a position in which an upper portion of the first inclined surface 10*f* in the vertical direction faces a corner of the positioning member 8*b* of the print head 8.

Figure 22A:
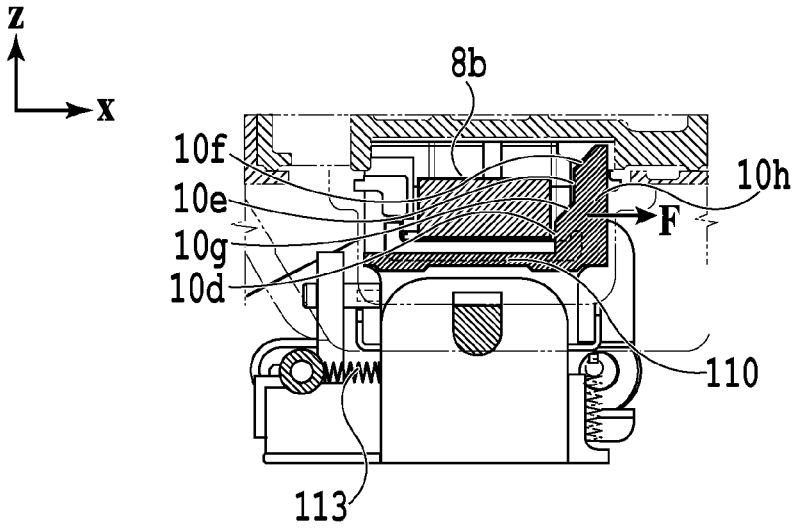
FIGS. 22A and 22B are cross-sectional views of the vicinity of the cap holder.
Figure 22B:
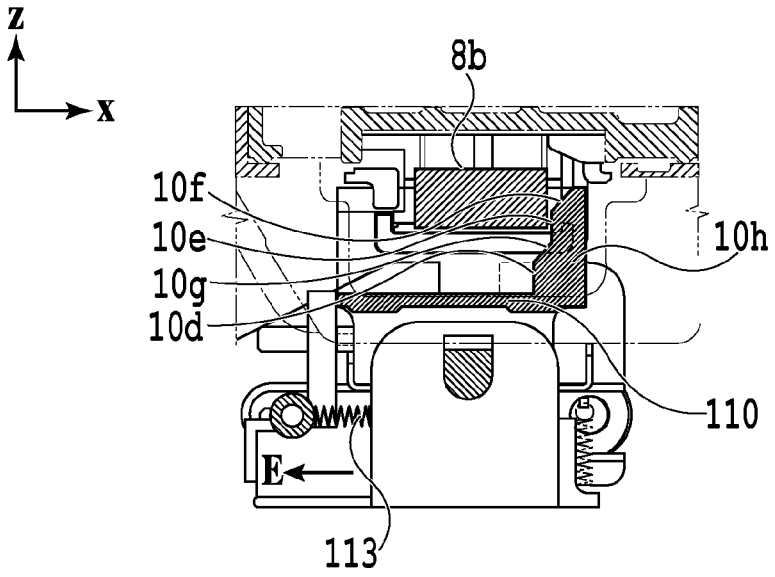

FIGS. 22A and 22B are cross-sectional views in the cross-section position A like FIG. 21. FIG. 22A shows a first relative position of the present embodiment and FIG. 22B shows a second relative position of the present embodiment. From the state shown in FIG. 21, the print head 8 moves down. While the print head 8 moves down, the positioning member 8*b* comes into contact with the first inclined surface 10*f*, the second positioning surface 10*e*, the second inclined surface 10*g*, and the first positioning surface 10*d* in this order. At this time, the first inclined surface 10*f* and the second inclined surface 10*g* cause the cap holder 110 to move in an arrow F direction of FIG. 22A (to the right). Moving down of the print head 8 to the position in which the ejection opening surface 8*a* of the print head 8 comes into contact with the cap member 10*a* allows the positioning surface of the positioning member 8*b* of the print head 8 to come into contact with the first positioning surface 10*d* of the cap holder 110. Accordingly, the print head 8 and the cap unit 10 move to the first relative position.

FIG. 22B shows that the print head 8 has moved up from the state shown in FIG. 22A. Moving up of the print head 8 causes the positioning surface of the positioning member 8*b* to be separated from the first positioning surface 10*d*. The head carriage control unit 208 stops the moving up of the print head 8 at a position in which the second positioning surface 10*e* of the cap holder 110 can come into contact with the positioning surface of the positioning member 8*b*. Since the cap holder 110 is biased in the arrow E direction of FIG. 22B by the cap holder spring 113, the second positioning surface 10*e* comes into contact with the positioning surface of the positioning member 8*b* of the print head. Accordingly, the print head 8 and the cap unit 10 move to the second relative position.

As described above, in the present embodiment, a plurality of relative positions can be achieved by the positioning portions at different portions of the cap unit 10 with respect to the positioning portion at one location of the print head 8.

Third Embodiment

In the present embodiment, description will be given of an aspect that a plurality of relative positions can be achieved by the positioning portions at different portions of the print head 8 with respect to the positioning portion at one location of the cap unit 10.

Figure 23A:
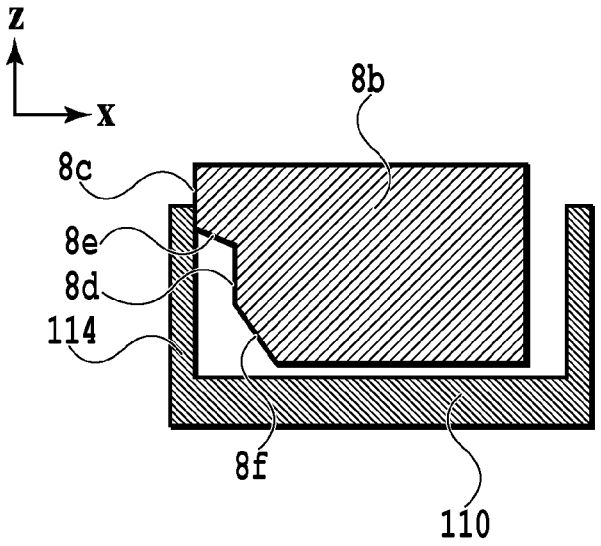
FIGS. 23A and 23B are diagrams illustrating an example of a positioning member.
Figure 23B:
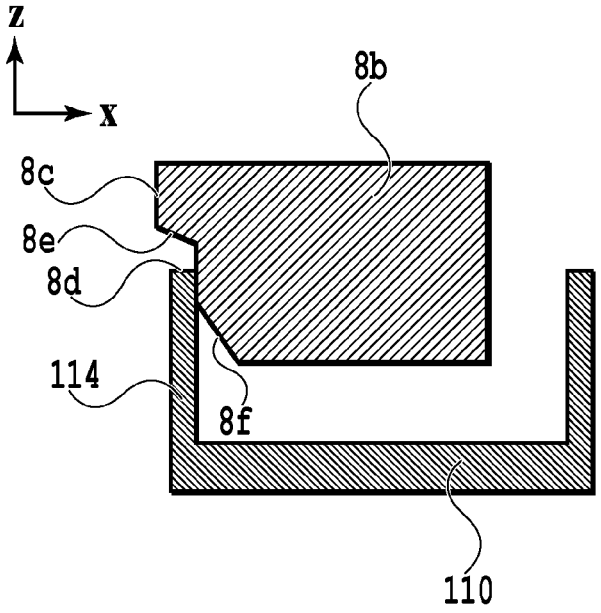

FIGS. 23A and 23B are schematic diagrams illustrating the present embodiment. In the present embodiment, the shape of the positioning member 8*b* of the print head 8 is different from the one in the first embodiment. The positioning member 8*b* of the print head 8 of the present embodiment at one end in the first direction (x-direction) is configured to have a plurality of steps. More specifically, a thickness of the print head 8 in the x-direction is configured to decrease in stages along a vertically downward direction. Furthermore, between the steps, an inclined surface is formed. In the present embodiment, as shown in FIG. 23A, the positioning member 8*b* of the print head 8 is provided with a first positioning surface 8*c*, a second positioning surface 8*d*, a first inclined surface 8*e*, and a second inclined surface 8*f*. It should be noted that, like the second embodiment, the cap holder 110 may be biased by a biasing unit to the left in FIGS. 23A and 23B. Alternatively, the cap holder 110 may move, after the vertical movement of the print head 8, according to the rotation of the sector gear as described in the first embodiment. FIG. 23A shows a first relative position and FIG. 23B shows a second relative position. In FIG. 23A, the first positioning surface 8*c* of the positioning member 8*b* of the print head 8 is in contact with a positioning member 114 of the cap holder 110. In FIG. 23B, the second positioning surface 8*d* of the positioning member 8*b* of the print head 8 is in contact with the positioning member 114 of the cap holder.

As described above, a plurality of relative positions can be achieved by the positioning portions at different portions of the print head 8 with respect to the positioning portion at one location of the cap unit 10.

Fourth Embodiment

In the above-described embodiments, description has been given of the example of the aspect that the first relative position and the second relative position are achieved by bringing the positioning members into contact each other. In the present embodiment, description will be given of an aspect that one of the print head 8 and the cap unit 10 has a positioning portion in a convex shape and the other of the print head 8 and the cap unit 10 has a positioning portion in a concave shape corresponding to the convex shape.

Figure 24A:
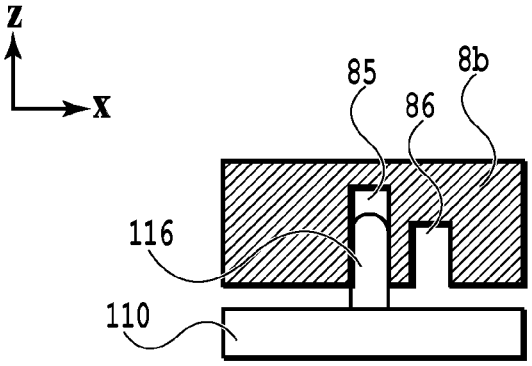
FIGS. 24A and 24B are diagrams illustrating an example of a positioning member.
Figure 24B:
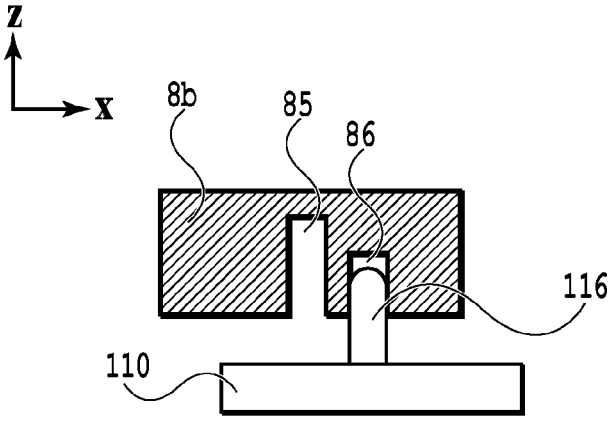

FIGS. 24A and 24B are schematic diagrams illustrating the present embodiment. The positioning member 8*b* of the print head 8 is provided with a plurality of concave portions 85, 86 in the first direction (x-direction). The cap holder 110 is provided with a positioning portion 116 in a convex shape on a bottom surface. FIG. 24A shows a first relative position and FIG. 24B shows a second relative position. In this manner, an aspect of engagement and positioning may be employed instead of the aspect of bringing the positioning members into contact with each other.

Furthermore, the present invention is not limited to the above examples, and any aspect may be employed as long as a relative position between the print head 8 and the cap unit 10 may be achieved.

Other Embodiments

In the above-described embodiments, the aspect that the first relative position and the second relative position are different in the first direction (x-direction) crossing the ejection opening array has been described. The ejection opening array may extend in the longitudinal direction (y-direction) of the print head or may extend in a direction inclined with a predetermined angle with respect to the y-direction. In every aspect, the first direction (x-direction) is a direction crossing the ejection opening array.

In the first embodiment, the aspect of using a movable member as the positioning member has been described, but in the other embodiments as well, a movable member may be used as the positioning member. In the second and third embodiments, the positioning member of the cap holder that comes into contact with the positioning member 8*b* of the print head 8 may be a movable member. Furthermore, in the fourth embodiment, the positioning portion in a convex shape of the cap holder may be a movable member. In addition, in the first embodiment, the positioning member 10*b* or 10*c* may have steps like the second embodiment. This allows locating three or more positions.

The example of the aspect that the positioning members are provided at both ends in the longitudinal direction of the print head 8 and the cap unit 10 has been described. However, the present invention is not limited to this. The positioning members may be provided in any positions in the longitudinal direction of the print head 8 and the cap unit 10.

It should be noted that the print head 8 of a full-line type has been described by way of example in the above embodiments, but the present invention is not limited to this and can be applied to a serial type print head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-133537, filed Jul. 7, 2017, which is hereby incorporated by reference wherein in its entirety.

What is claimed is:

1. A liquid ejecting apparatus for printing a print medium by using a print head having an ejection opening surface on which an ejection opening array for ejecting a liquid is provided, the liquid ejecting apparatus comprising:

a cap unit for protecting the ejection opening array; and a moving unit configured to relatively move the print head and the cap unit, wherein the cap unit includes a first positioning portion for locating the print head and the cap unit in a first relative position by abutting on a head positioning member of the print head and a second positioning portion for locating the print head and the cap unit in a second relative position different from the first relative position by abutting on the head positioning member of the print head.

2. The liquid ejecting apparatus according to claim 1, wherein the ejection opening array is provided in a first direction and the second relative position is different from the first relative position in a second direction crossing the first direction.

3. The liquid ejecting apparatus according to claim 1, wherein the moving unit moves the print head.

4. The liquid ejecting apparatus according to claim 1, wherein the moving unit moves both the print head and the cap unit.

5. The liquid ejecting apparatus according to claim 1, wherein the second positioning portion is movable.

6. The liquid ejecting apparatus according to claim 5, wherein the ejection opening array is provided in a first direction and the second relative position is different from the first relative position in a second direction crossing the first direction, and wherein the second positioning portion is movable in a direction crossing the first direction and the second direction.

7. The liquid ejecting apparatus according to claim 5, wherein the second positioning portion is biased by a biasing member.

8. The liquid ejecting apparatus according to claim 7, wherein the biasing member includes a spring.

9. The liquid ejecting apparatus according to claim 1, further comprising:

a preliminary ejection unit configured to perform a preliminary ejection operation of preliminarily ejecting the liquid from the ejection opening array, wherein the preliminary ejection unit performs a preliminary ejection operation of a first liquid in the first relative position and performs a preliminary ejection operation of a second liquid different from the first liquid in the second relative position.

10. The liquid ejecting apparatus according to claim 9, wherein the first liquid is color ink and the second liquid is black ink.

11. The liquid ejecting apparatus according to claim 1, wherein on the print head, a plurality of ejection openings corresponding to a width of the print medium are provided on the ejection opening surface.

12. The liquid ejecting apparatus according to claim 1, further comprising the print head.

13. A liquid ejecting apparatus for printing a print medium by using a print head having an ejection opening surface on which an ejection opening array for ejecting a liquid is provided, the liquid ejecting apparatus comprising:

a cap unit for protecting the ejection opening array;

a moving unit configured to relatively move the print head and the cap unit;

a first positioning portion for locating the print head and the cap unit in a first relative position where the print head and the cap unit come into contact with each other; and a second positioning portion for locating the print head and the cap unit in a second relative position different from the first relative position, where the print head and the cap unit come into contact with each other, wherein the second positioning portion is movable.

14. The liquid ejecting apparatus according to claim 13, further comprising the print head.

15. The liquid ejecting apparatus according to claim 13, wherein on the print head, a plurality of ejection openings corresponding to a width of the print medium are provided on the ejection opening surface.

16. A liquid ejecting apparatus for printing a print medium by using a print head having an ejection opening surface on which an ejection opening array for ejecting a liquid is provided in a first direction, the liquid ejecting apparatus comprising:

a cap unit for protecting the ejection opening array;

a moving unit configured to relatively move the print head and the cap unit;

a first positioning portion for locating the print head and the cap unit in a first relative position where the print head and the cap unit come into contact with each other; and a second positioning portion for locating the print head and the cap unit in a second relative position where the print head and the cap unit come into contact with each other, wherein a plurality of ejection openings corresponding to a width of the print medium, are provided on the ejection opening surface, and wherein the second relative position is different from the first relative position in a second direction crossing the first direction.

17. The liquid ejecting apparatus according to claim 16, further comprising the print head.

18. The liquid ejecting apparatus according to claim 16, wherein, on the print head, a plurality of ejection openings corresponding to a width of the print medium are provided on the ejection opening surface.

19. A liquid ejecting apparatus for printing a print medium by using a print head having an ejection opening surface on which an ejection opening array for ejecting a liquid is provided, the liquid ejecting apparatus comprising:

a cap unit for protecting the ejection opening array; and a moving unit configured to relatively move the print head and the cap unit, wherein the cap unit includes a first positioning portion for locating the print head and the cap unit in a first relative position by abutting on a first head positioning member provided on the print head and a second positioning portion for locating the print head and the cap unit in a second relative position different from the first relative position by abutting on a second head positioning member provided on the print head.

20. The liquid ejecting apparatus according to claim 19, wherein the first head positioning member is a first surface of the print head and the second head positioning member is a second surface of the print head.

21. The liquid ejecting apparatus according to claim 19, wherein the second positioning portion is movable.

22. The liquid ejecting apparatus according to claim 19, wherein the ejection opening array is provided in a first direction and the second relative position is different from the first relative position in a second direction crossing the first direction.

23. The liquid ejecting apparatus according to claim 19, wherein the moving unit moves the print head.

24. The liquid ejecting apparatus according to claim 19, wherein the moving unit moves both the print head and the cap unit.

25. The liquid ejecting apparatus according to claim 19, further comprising the print head.

26. A liquid ejecting apparatus for printing a print medium by using a print head having an ejection opening surface on which an ejection opening array for ejecting a liquid is provided, the liquid ejecting apparatus comprising:

a cap unit for protecting the ejection opening array; and a moving unit configured to relatively move the print head and the cap unit, wherein the print head includes a first head positioning member for locating the print head and the cap unit in a first relative position by abutting on a positioning portion provided on the cap unit and a second head positioning member for locating the print head and the cap unit in a second relative position different from the first relative position by abutting on the positioning portion provided on the cap unit.

27. The liquid ejecting apparatus according to claim 26, wherein the first head positioning member is a first surface of the print head and the second head positioning member is a second surface of the print head.

28. The liquid ejecting apparatus according to claim 26, wherein the second positioning portion is movable.

29. The liquid ejecting apparatus according to claim 26, wherein the ejection opening array is provided in a first direction and the second relative position is different from the first relative position in a second direction crossing the first direction.

30. The liquid ejecting apparatus according to claim 26, wherein the moving unit moves the print head.

31. The liquid ejecting apparatus according to claim 26, wherein the moving unit moves both the print head and the cap unit.

32. The liquid ejecting apparatus according to claim 26, further comprising the print head.

* * * * *